US010840586B2

(12) United States Patent
Mata Garcia et al.

(10) Patent No.: US 10,840,586 B2
(45) Date of Patent: Nov. 17, 2020

(54) BROADBAND LTE ANTENNA SYSTEM FOR A VEHICLE

(71) Applicant: Advanced Automotive Antennas, S.L.U., Barcelona (ES)

(72) Inventors: Victor Mata Garcia, Barcelona (ES); Enrique Martinez Ortigosa, Barcelona (ES); Ramiro Quintero Illera, Barcelona (ES)

(73) Assignee: Advanced Automotive Antennas, S.L.U., Barcelona (ES)

( * ) Notice: Subject to any disclaimer, the term of this patent is extended or adjusted under 35 U.S.C. 154(b) by 112 days.

(21) Appl. No.: 16/248,387

(22) Filed: Jan. 15, 2019

(65) Prior Publication Data

US 2019/0221925 A1 Jul. 18, 2019

(30) Foreign Application Priority Data

Jan. 15, 2018 (EP) ..... 18382011

(51) Int. Cl.
*H01Q 1/32* (2006.01)
*H01Q 1/48* (2006.01)
(Continued)

(52) U.S. Cl.
CPC ..... *H01Q 1/3275* (2013.01); *H01Q 1/38* (2013.01); *H01Q 1/48* (2013.01); *H01Q 1/521* (2013.01);
(Continued)

(58) Field of Classification Search
CPC ..... H01Q 1/38; H01Q 9/40; H01Q 1/521; H01Q 1/48; H01Q 5/378; H01Q 1/3275; H01Q 5/335; H01Q 21/28
See application file for complete search history.

(56) References Cited

U.S. PATENT DOCUMENTS 4,012,741 A * 3/1977 Johnson ..... H01Q 9/0428 343/700 MS
7,042,414 B1 * 5/2006 Lee ..... H01Q 1/243 343/795
(Continued)

FOREIGN PATENT DOCUMENTS

JP 2005110123 A 4/2005
JP 2012200007 A 10/2012

OTHER PUBLICATIONS

Eldek, A. A., "Numerical Analysis of a Small Ultra Wideband Microstrip-Fed Tap Monopole Antenna," Progress in Electromagnetics Research, PIER 65, 59-69, 2006.
(Continued)

*Primary Examiner* — Graham P Smith
*Assistant Examiner* — Jae K Kim
(74) *Attorney, Agent, or Firm* — Brooks Kushman, P.C.

(57) ABSTRACT

A broadband LTE antenna system for a vehicle, comprising a main LTE antenna system and a secondary LTE antenna, both antennas being arranged relative to each other, such as their radiation patterns are perpendicular to each other wherein the main LTE antenna comprises a ground plane circumscribed by a rectangle having major and minor sides, a dielectric substrate comprising a first portion area, a radiating element for operating at a frequency band and having at least three angles and three sides, a first side being substantially aligned with one side of the rectangle, and a first angle having an apex being the closest point of the radiating element to the ground plane, and a conductive element having at least a first portion extending between the radiating element and one side of the first portion area.

20 Claims, 22 Drawing Sheets

(51) Int. Cl.

| | |
|---|---|
| ***H01Q 5/378*** | (2015.01) |
| ***H01Q 9/40*** | (2006.01) |
| ***H01Q 21/28*** | (2006.01) |
| ***H01Q 5/335*** | (2015.01) |
| ***H01Q 1/38*** | (2006.01) |
| ***H01Q 1/52*** | (2006.01) |

(52) U.S. Cl.
CPC ..... *H01Q 5/335* (2015.01); *H01Q 5/378* (2015.01); *H01Q 9/40* (2013.01); *H01Q 21/28* (2013.01)

(56) References Cited

U.S. PATENT DOCUMENTS 9,077,066 B1 7/2015 Lee
2005/0146471 A1* 7/2005 Kwon ..... H01Q 9/28 343/702
2006/0017620 A1* 1/2006 Chen ..... H01Q 9/40 343/700 MS
2006/0066487 A1* 3/2006 Park ..... H01Q 1/38 343/700 MS
2006/0103577 A1* 5/2006 Lee ..... H01Q 9/40 343/700 MS
2010/0328164 A1* 12/2010 Huynh ..... H01Q 5/378 343/702
2013/0187816 A1* 7/2013 Chung ..... H01Q 1/48 343/722
2014/0043204 A1 2/2014 Basnayake et al.
2014/0085159 A1 3/2014 Wong et al.

OTHER PUBLICATIONS

Alsath, M. Gulam Nabi, and Kanagasabai, Malathi, "Compact UWB Monopole Antenna for Automotive Communications," IEEE Transactions on Antennas and Propagation, vol. 64, No. 9, Sep. 2015.

* cited by examiner

BROADBAND LTE ANTENNA SYSTEM FOR A VEHICLE

CROSS-REFERENCE TO RELATED APPLICATIONS

This application claims priority to European Patent Application Serial No. EP 18382011.7 filed Jan. 15, 2018, the disclosure of which is hereby incorporated in its entirety by reference herein.

TECHNICAL FIELD

The present disclosure relates to a design of an antenna system, specifically designed for being installed on a vehicle, and preferably, for operating on the LTE (Long Term Evolution) network. This antenna is also designed for being capable of integrating different antennas to provide additional communication services. One object of this disclosure is to provide an antenna system having a broad bandwidth behavior, which is capable of offering a high efficiency, and which is capable of reducing the size of existing antenna systems for vehicles.

Another object of this disclosure is to provide an antenna system capable of covering all the 4G frequency bands, ensuring that the antenna maintains the desired behavior at the whole band of operation, and in particular, at the lower LTE frequency range 700-800 MHz.

Another object of the disclosure, is to achieve a low ECC (Envelop Correlation Coefficient) in LTE bands with integrated LTE antennas in a small Printed Circuit Board (PCB).

BACKGROUND

Traditionally, vehicles have been provided with antennas mounted in different locations of the vehicle. Usually, these antennas were broadband monopoles located at the rear window and/or on the roof.

FIG. 1*a* shows a lateral view of a vehicle having a conventional antenna 12 mounted on the roof of the vehicle. FIG. 1*b* shows a detailed view of the antenna 12 shown in FIG. 1*a*, where the antenna 12 is fed by a coaxial cable 14 and the roof acts as a ground plane 13.

Over the years, the number of radio-communication services has increased and, in consequence, the number of antennas required for providing these services.

Also, aesthetic and aerodynamic trends have changed and, over the years, satisfying customer tastes has become essential in the automotive industry. Lately, customer tastes generally lead to vehicles having a streamlined and smooth 10 appearance, which interfere with providing the vehicle with multiple and dispersed antennas.

Thus, both for meeting customer tastes and providing all the radiocommunication services possibly demanded by the driver, the automotive industry is tending to integrate in a single module all the communication modules specifically designed for providing one communication service, such as telephony, AM/FM radio, satellite digital audio radio services (SDARS), global navigation satellite system (GNSS), or digital audio broadcasting (DAB).

The integration of multiple antenna units in a single global antenna module leads to achieve great advantages in costs, quality and engineering development time.

This global antenna module is subject to meet current customer tastes. For that, it would be desirable to reduce the size of traditional antenna systems in order to be able to integrate them in a module that can maintain the streamlined appearance of the vehicle. However, reducing the size of an antenna system affects its performance.

Further, the automotive industry has to meet customer demands on communication, being thus obliged to provide robust communications in all services available for the driver. For that, it would be desirable to provide an antenna system able to operate in a broad bandwidth with high efficiency.

Then, it would be desirable to develop an improved antenna system for a vehicle that having a reduced size, offers a high efficiency and a broadband behavior.

It would be also desirable that the improved antenna system operates on all LTE frequency bands without losing its broadband and high efficient characteristics in any band.

On the other hand, lots of electronic devices need to integrate antennas to reduce the cost of an external antenna and also because it makes the integration of the system easy (no need to worry about external antenna integration).

In that scenario, when the telephony throughput (the amount of data you can send per second) want be improved is necessary to move a MIMO systems (Multiple Input Multiple Output). This means the radio is capable of transmitting and receiving multiple data streams simultaneously.

In order to transmit and receive simultaneous and independent data streams the antennas should have their radiation patterns as different as possible between them (decorrelated). The parameters that measure the radiation pattern correlation is the ECC (Envelope Correlation Coefficient). Ideally two antennas completely decorrelated has ECC=0 (Perfect ECC) and completely correlated ECC=1 (the worst ECC).

It is a challenge to integrate two LTE MIMO antennas in a PCB of small dimensions and low ECC due to the low isolation of the antennas and the correlation in LTE low bands (700 MHz).

SUMMARY

The present disclosure overcomes the above mentioned drawbacks by providing a design of a broadband antenna system for a vehicle, which having a reduced size is capable of providing a high bandwidth and a high efficiency, also at all LTE frequency bands.

One aspect of the disclosure refers to a broadband LTE antenna system for a vehicle, comprising two LTE antennas, namely: a main LTE antenna system and a secondary LTE antenna, wherein the two LTE antennas are arranged relative to each other, such as their radiation patterns (the null thereof) are perpendicular to each other, that is, their radiation patterns are decorrelated to improve the ECC parameter (ideally ECC=0) thereby achieving a good MIMO system.

The main LTE antenna comprises a radiating element for operating at at least one frequency band of operation and disposed on at least a first portion area of a 10 dielectric material, a substrate, a conductive element disposed on that first portion area, a grounding point, a feeding element, and a ground plane circumscribed by a rectangle having said circumscribed rectangle minor and major sides.

The ground plane has a first pair of opposing sides and a second pair of opposing sides defining a quadrangular (squared) or rectangular shape. The radiating element and the secondary LTE antenna are arranged at orthogonal sides of the ground plane, so that their radiation patterns are perpendicular to each other.

The ground plane can be disposed on the same substrate with the radiating element, disposed on a second portion area of the substrate, or disposed perpendicular to the radiating element, outside the substrate.

The radiating element has at least three angles and at least three sides, a first side being substantially aligned with one side of the circumscribed rectangle and a first angle having an apex, said apex being the closest point of the radiating element to the ground plane.

The conductive element has at least a first portion extending between one of the sides of the first portion area of the substrate and the radiating element. The conductive element is electrically isolated from the radiating element, having no electric connection therebetween. Further, the conductive element is coupled to ground plane through the grounding point.

The grounding point is disposed at one extreme of the first portion area of the substrate. The feeding element is electromagnetically coupled with the radiating element through the apex of the first angle.

Additionally, each major side of the ground plane has an electric length (Lgp) of at least 0.13λ, being λ the lowest frequency of the antenna's band operation, and the first angle of the radiating element having an aperture lower than 156°, said aperture preferably ranging from 80° to 156°, having an optimum range from 1° to 156° and with a optimum aperture value of 150°.

Preferably, the conductive element has an electric length, and the sum of the electric length of the major side of the ground plane and the electric length of the conductive element ranges from 0.18λ to 0.22λ, being λ the lowest frequency of the antenna's band operation.

Preferably, the radiating element has a length measured from the first side to the first angle lower than 1/10λ, and a width measured as the length of the first side of the radiating element lower than 1/8λ, being λ the lowest frequency of the antenna's band operation.

Also, the first portion of the conductive element is bigger than 1/8λ, being λ the lowest frequency of the antenna's band operation.

Providing the radiating element and the conductive element as described, the LTE main antenna modifies the electric length of the ground plane, modifying its frequency behavior. This modified frequency behavior brings the resonance of the ground plane to lower frequencies, surging a new resonant frequency, which in case of the radiating element operates at the LTE frequency band of operation, a new resonant frequency surges at the LTE 700 band.

For instance, for the LTE frequency band of operation, the disclosure provides an antenna system capable of covering the lowest frequencies of LTE on a ground plane of reduced dimensions, in particular, on a ground plane of at least 0.13λ, being λ the lowest frequency of the antenna's band operation, i.e. λ=700 MHz (ground plane: 55.9 mm).

In a preferred embodiment, the ground plane has a rectangular configuration having first two opposing sides, and second two opposing sides. The secondary LTE antenna is a printed antenna on a PCB, and it is arranged at one of the first two opposing sides of the ground plane. Preferably, the secondary LTE antenna is orthogonally arranged with respect to the ground plane. Alternatively, the secondary LTE antenna is coplanar with the groundplane and with the radiating element.

Thus, the disclosure provides a broadband LTE antenna system having high efficient characteristics, such as: very high bandwidth (BW) covering the Low Frequency region: 700-960 MHz, and the High Frequency region: 1600-2900 MHz; relative BW (Low Frequency region: 31%, High frequency region: 57%); Voltage Standing Wave Ratio (VSWR)<2.5 on the 95% of the BW; High Efficiency (Low Frequency region>80%. High Frequency region: ≈80%); very compact solution: being able to be integrated on a ground plane of at least 55×55 mm.

BRIEF DESCRIPTION OF THE DRAWINGS

For a better comprehension of the invention, the following drawings are provided for illustrative and non-limiting purposes, wherein:

FIG. 1 shows lateral views of a prior art vehicle monopole antenna.

PREFERRED EMBODIMENTS OF THE INVENTION

Figure 1A:
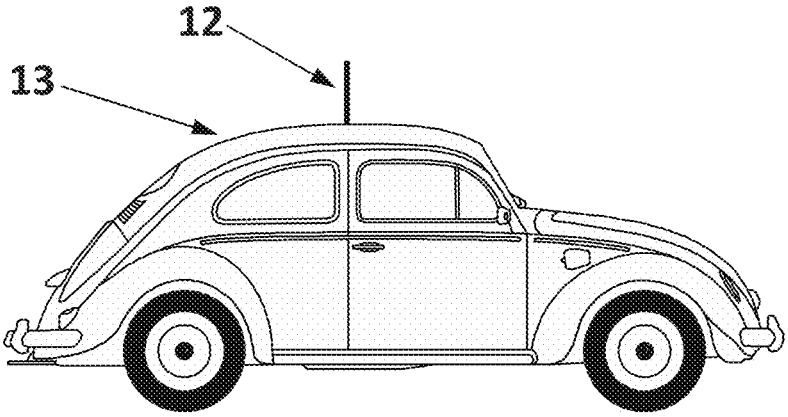
FIG. 1a (PRIOR ART)
FIG. 1*a* shows the antenna installed on the roof of a vehicle.
Figure 1B:
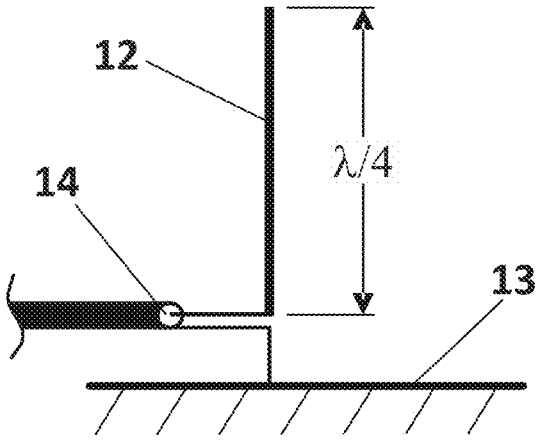
FIG. 1b (PRIOR ART)
FIG. 1*b* shows a detailed view of the antenna of FIG. 1*a*.
Figure 2:
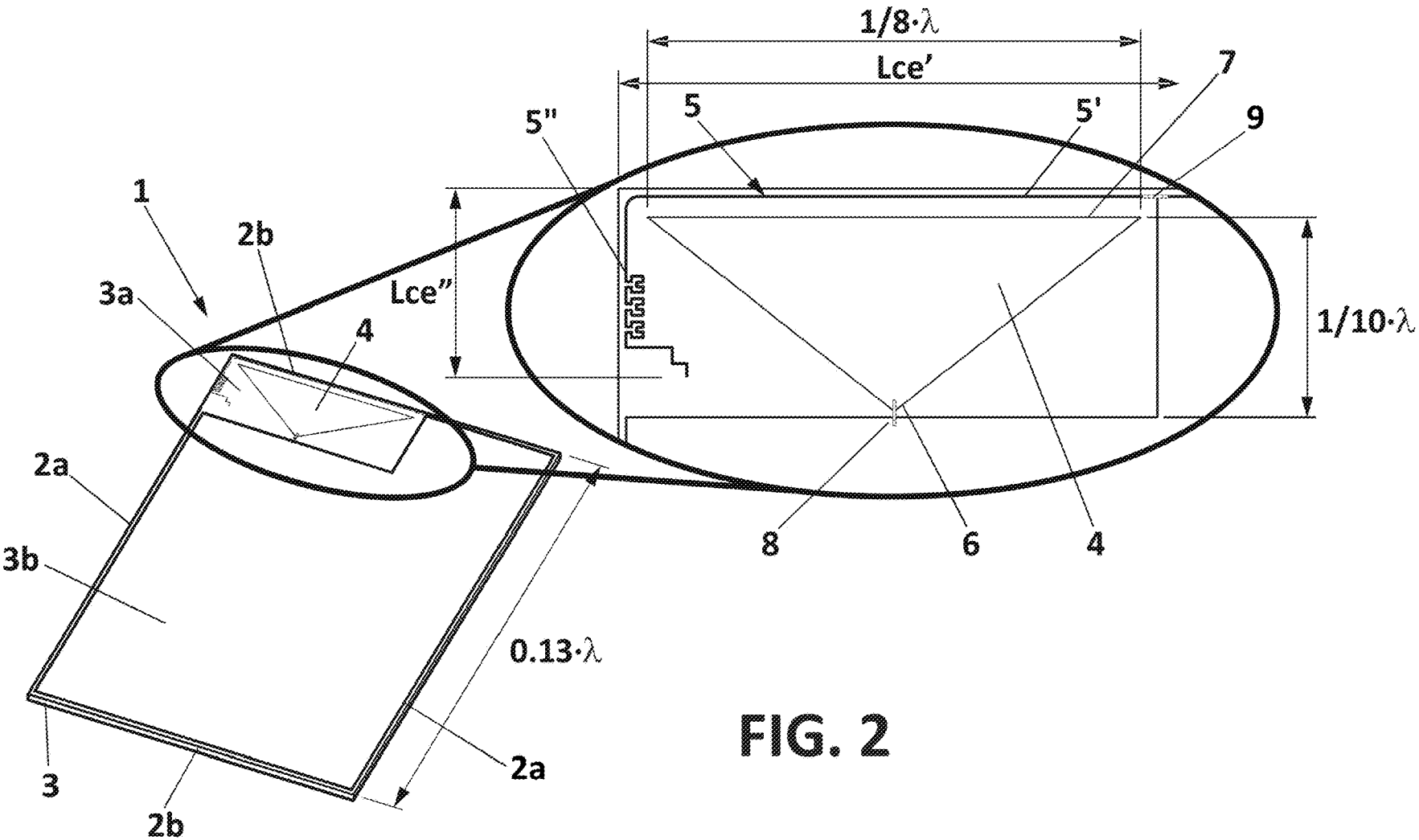
FIG. 2 shows a perspective and detailed view of a main LTE antenna.

FIG. 2 shows a main LTE antenna 1 for a vehicle. As shown, the main LTE antenna 1 comprises a ground plane 2, first and second portion areas 3*a*, 3*b* of a dielectric substrate 3, a radiating element 4 for operating at a LTE frequency band, a conductive element 5, and a feeding 8 and a grounding point 9.

The ground plane 2 has a rectangular configuration, having major 2*a* and minor 2*b* sides. The ground plane 2 is disposed on the second portion area 3*b* of the substrate 3, while the radiating element 4 is disposed on the first portion area 3*a* of the substrate 3.

The ground plane 2 and the radiating element 4 are on the same substrate 3 and can be formed into a single body, where the second portion area 3*b* of the substrate 3 allocates the ground plane 2, and the first portion area 3*a* of the substrate 3 allocates the radiating element 4. Further, the first portion area 3*a* of the substrate 3 allocates the conductive element 5, the grounding point 9, and the feeding element 8.

The first portion area 3*a* is disposed on a corner of the substrate 3 and the second portion area 3*b* is disposed on the rest of the substrate 3. The grounding point 9 is disposed at the upper extreme of the first portion area 3*a* of the substrate 3, and preferably at the interface between the first 3*a* and the second portion area 3*b* of the substrate 3. The grounding point 9 is coupled to the ground plane 2. The feeding element 8 is adapted to feed the radiating element 4, and is electromagnetically coupled with said radiating element 4.

The radiating element 4 has at least three angles and three sides, a first side 7 is aligned with the upper minor side 2*b* of the ground plane 2, and a first angle 6 whose vertex is the closest point to the ground plane 2. Further, the first angle 6 is opposite to the midpoint of the first side 7, wherein the first side 7 is the longer side of the radiating element 4. The first angle 6 has an aperture lower than 156°, such as 150°. In FIG. 2, the radiating element 4 has a substantially triangular configuration, however, other configurations are possible.

As shown in the detailed view of FIG. 2, the conductive element 5 is disposed on the first portion area 3*a* of the substrate 3, and is electrically isolated from the radiating element 4. The conductive element 5 has a first portion 5' extending between the upper side of the first portion area 3*a* of the substrate 3 and the radiating element 4, and a second portion 5" extending between the left side of the first portion area 3*a* of the substrate 3 and the radiating element 4.

Preferably, the first portion 5' of the conductive element 5 is bigger than ⅛λ, being λ the lowest frequency of the at least one LTE frequency band of operation of the broadband LTE antenna system.

Also, the first portion 5' of the conductive element 5 is preferably spaced 50 μm from the radiating element 4.

Preferably, as shown in FIG. 2, one extreme of the conductive element 5 is coupled to the ground plane 2 through the grounding point 9, and the other extreme is open, having a space-filling curve configuration. The space-filling curve configuration allows reducing the length of the conductive element 5.

For purposes of describing this disclosure, space-filling curve should be understood as defined in U.S. Pat. No. 7,868,834B2, in particular, in paragraphs [0061]-[0063], and FIG. 10.

Figure 3:
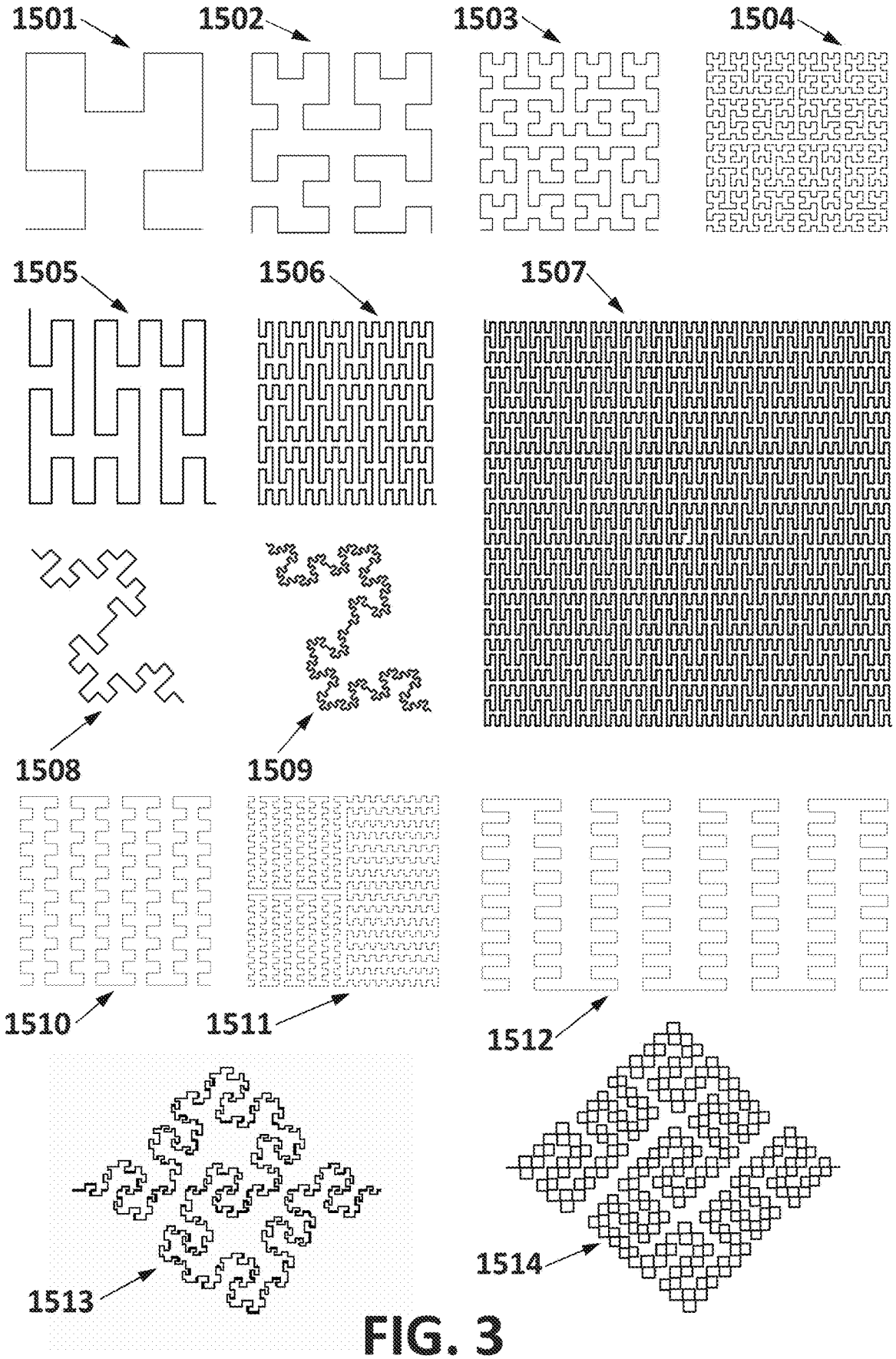
FIG. 3 shows examples of prior art space-filling curves that can be added to reduce the length of the conductive element.

One extreme of the conductive element 5 of the main LTE antenna 1 described herein may be shaped as a space-filling curve. FIG. 3 shows examples of spacefilling curves. Space-filling curves 1501 through 1514 are examples of space filling curves for antenna designs. Space-filling curves fill the surface or volume where they are located in an efficient way while keeping the linear properties of being curves.

A space-filling curve is a non-periodic curve including a number of connected straight segments smaller than a fraction of the operating free-space wave length, where the segments are arranged in such a way that no adjacent and connected segments form another longer straight segment and wherein none of said segments intersect each other.

In one example, an antenna geometry forming a space-filling curve may include at least five segments, each of the at least five segments forming an angle with each adjacent segment in the curve, at least three of the segments being shorter than one-tenth of the longest free-space operating wavelength of the antenna. Each angle between adjacent segments is less than 180° and at least two of the angles between adjacent sections are less than 115°, and at least two of the angles are not equal. The example curve fits inside a rectangular area, the longest side of the rectangular area being shorter than one-fifth of the longest free-space operating wavelength of the antenna. Some space-filling curves might approach a self-similar or self-affine curve, while some others would rather become dissimilar, that is, not displaying self-similarity or self-affinity at all (see for instance 1510, 1511, 1512).

The major side 2*a* of the ground plane 2 has an electric length (Lgp) of at least 0.13λ, being λ the lowest frequency of the at least one LTE frequency band of operation of the broadband LTE antenna system, i.e. 700 MHz (λ=43 cm).

The electric length of the ground plane (Lgp) is modified by the electric length (Lce) of the conductive element 5, which acts as an extensor of the ground plane. The electric length (Lce) of the conductive element 5 is the sum of the electric length of the first (Lce') and second portion (Lce") of the conductive element 5, that is, Lce=Lce'+Lce".

Preferably, the sum of the electric length (Lgp) of a major side (2*a*) of the ground plane 2 and the electric length (Lce) of the conductive element 5 ranges from 0.18λ to 0.22λ, being λ the lowest frequency of the at least one LTE frequency band of operation of the broadband LTE antenna system.

Figure 4:
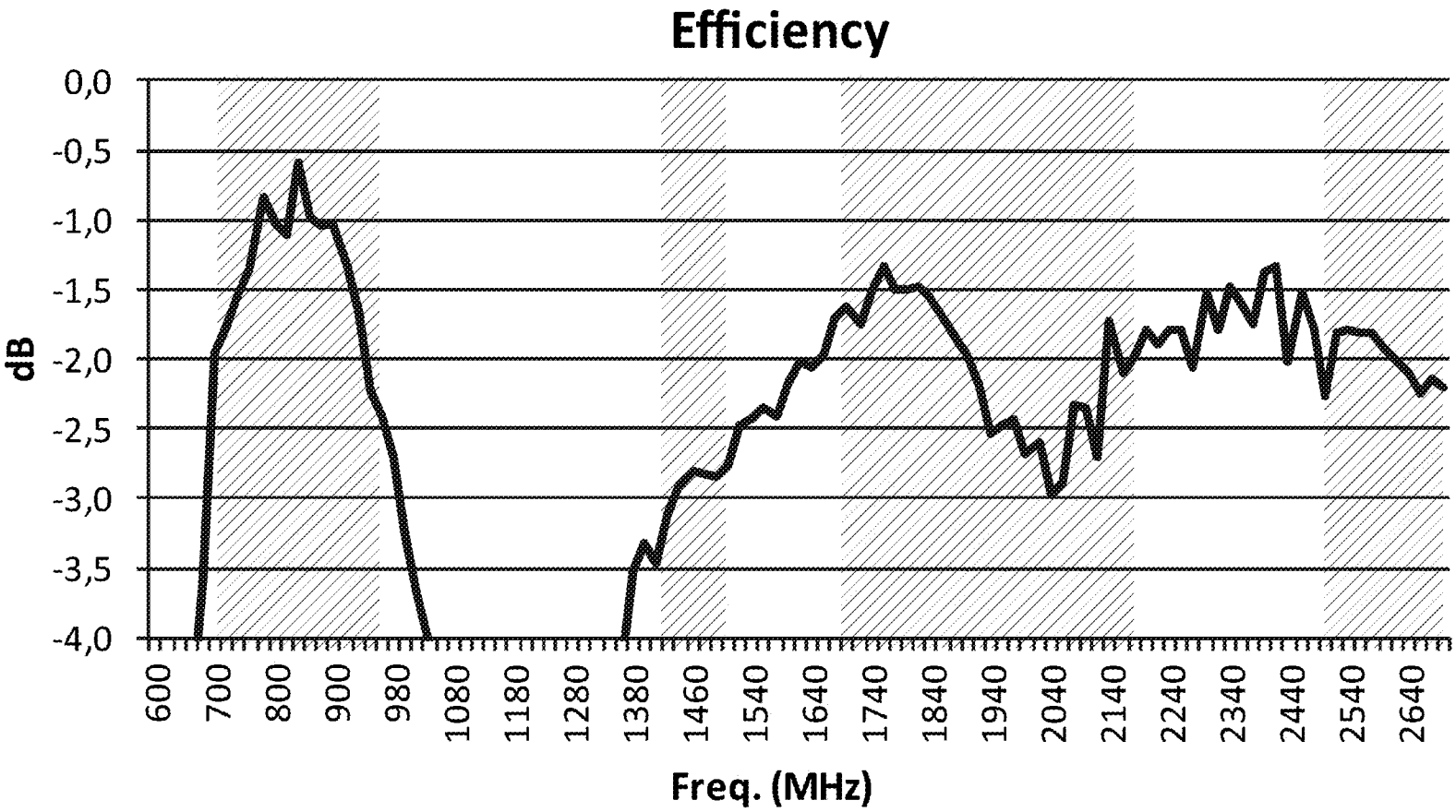
FIG. 4 shows a graphic of the efficiency of the main LTE antenna of FIG. 2.
Figure 5:
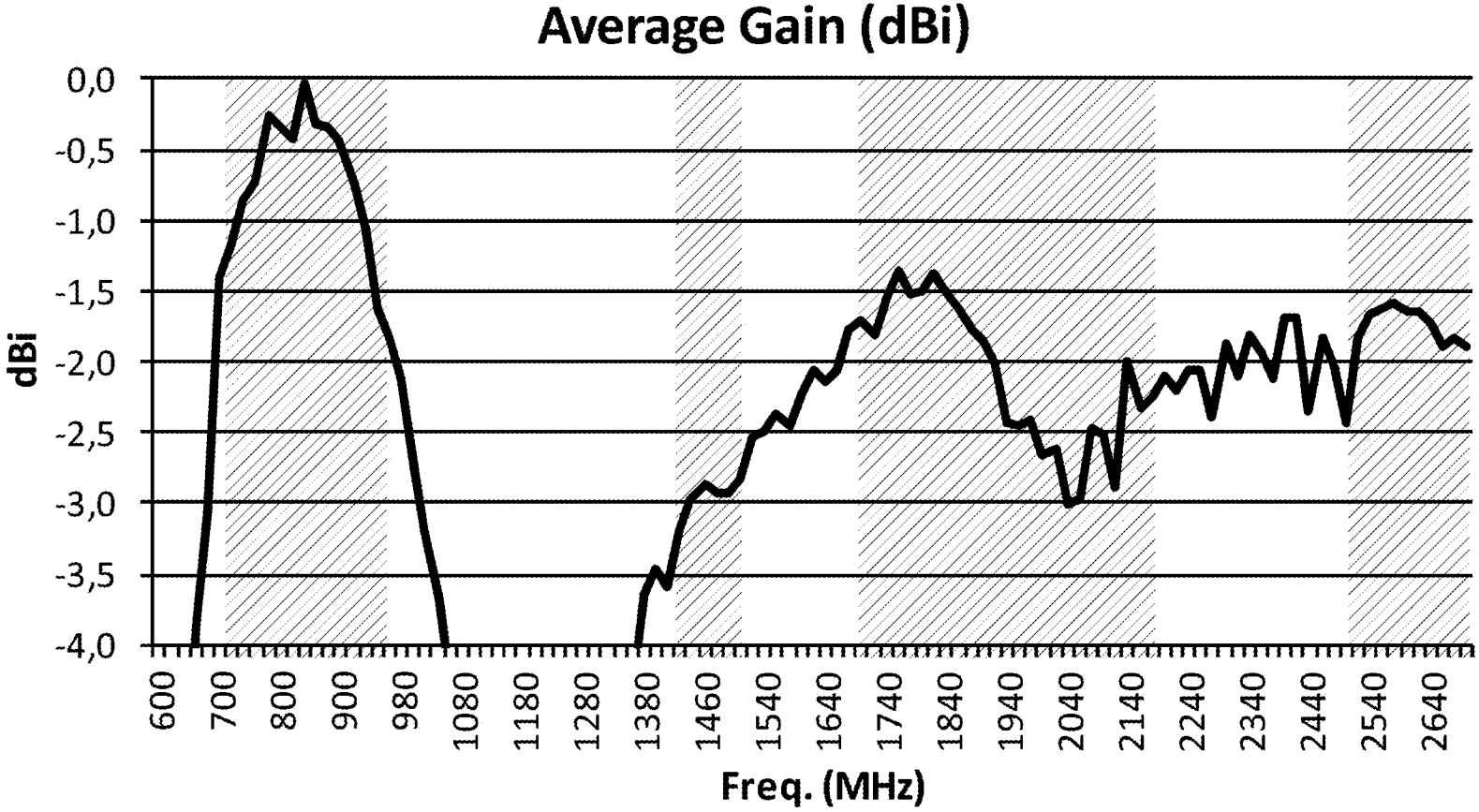
FIG. 5 shows a graphic of the average gain of the main LTE antenna of FIG. 2.
Figure 6:
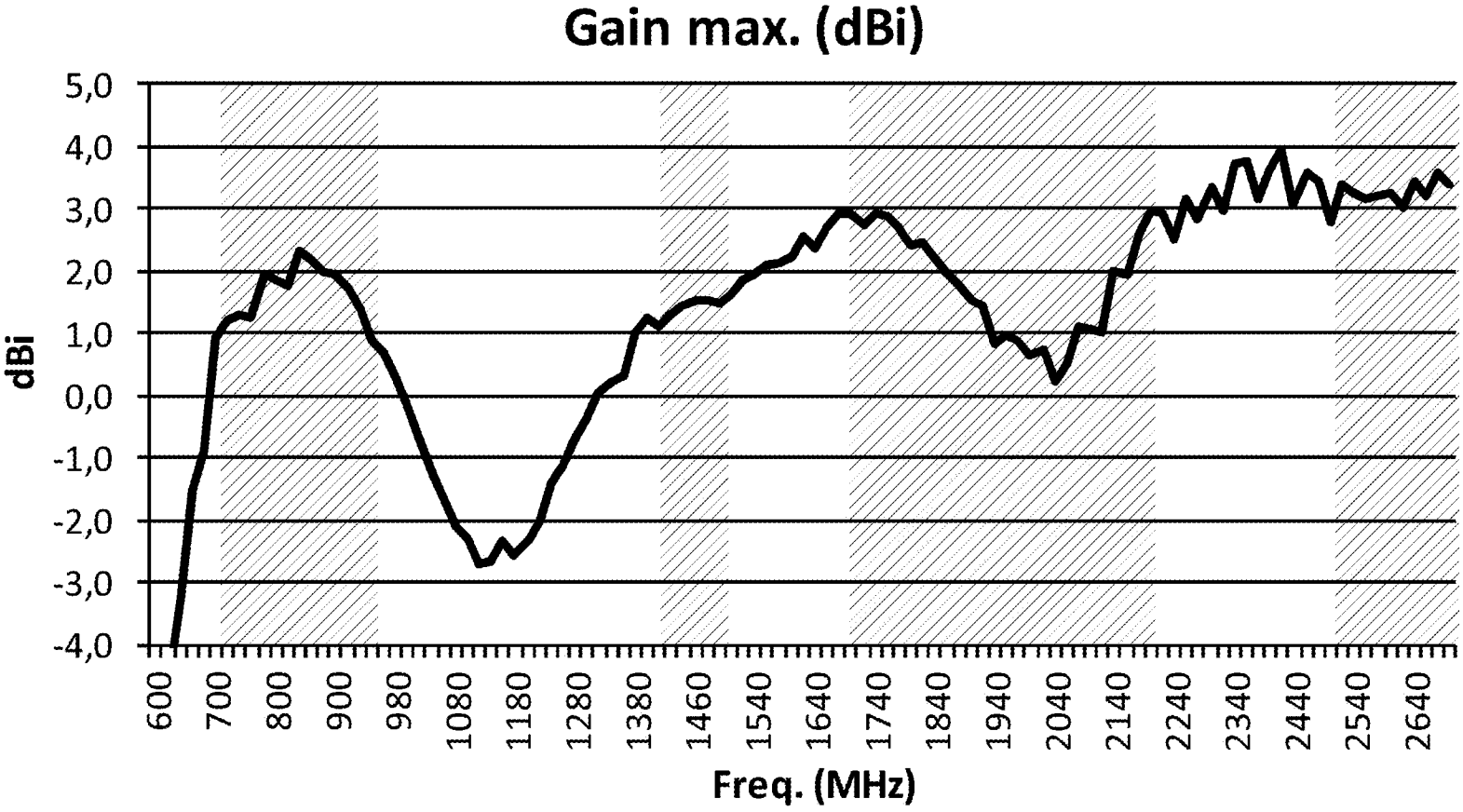
FIG. 6 shows a graphic of the maximum gain of the main LTE antenna of FIG. 2.

FIGS. 4-6 respectively show graphics of the efficiency, the average gain, and maximum gain of the main LTE antenna 1, shown in FIG. 2.

As shown, the broadband LTE antenna system covers LTE frequency bands ranging from 700 MHz to 960 MHz with an efficiency greater than −2 dB, an average gain greater than −1.5 dBi and maximum gain greater than 1 dBi. Thus, the broadband antenna system satisfies customer requirements covering the lower 4G frequency bands (LTE 700/LTE 800) with good directivity and minor power losses (high efficiency) with better frequency response than current mobile phone antennas, which have 6 dB of losses.

Also, as shown in FIGS. 4-6, the main LTE antenna 1 covers the LTE frequency band ranging from 1400 MHz to 1500 MHz with an efficiency greater than −3 dB, an average gain greater than −3 dBi, and maximum gain greater than 1 dBi. Thus, the main LTE antenna 1 provides a high-efficiency antenna.

FIGS. 4-6 also show that the main LTE antenna 1 at the LTE frequency band ranging from 1700 to 20 MHz has an average efficiency greater than −2.5 dB, an average gain greater than −2.5 dBi, and maximum gain greater than 0 dBi. Gain values of the main LTE antenna 1 fulfil antenna's specification of telephony operators.

Also, the main LTE antenna 1 provides at the LTE frequency band ranging from 00 to 2700 an efficiency greater than −2.5 dB, an average gain greater than 2 dBi, and maximum gain greater than 3 dB. Thus, the main LTE antenna 1 provides very high directive and efficiency features at this range.

The main LTE antenna 1 further may comprise a matching network coupling the radiating element 4 with the feeding element 8. The matching network may consist on a transmission line or a multiple section of transmission lines.

Figure 7:
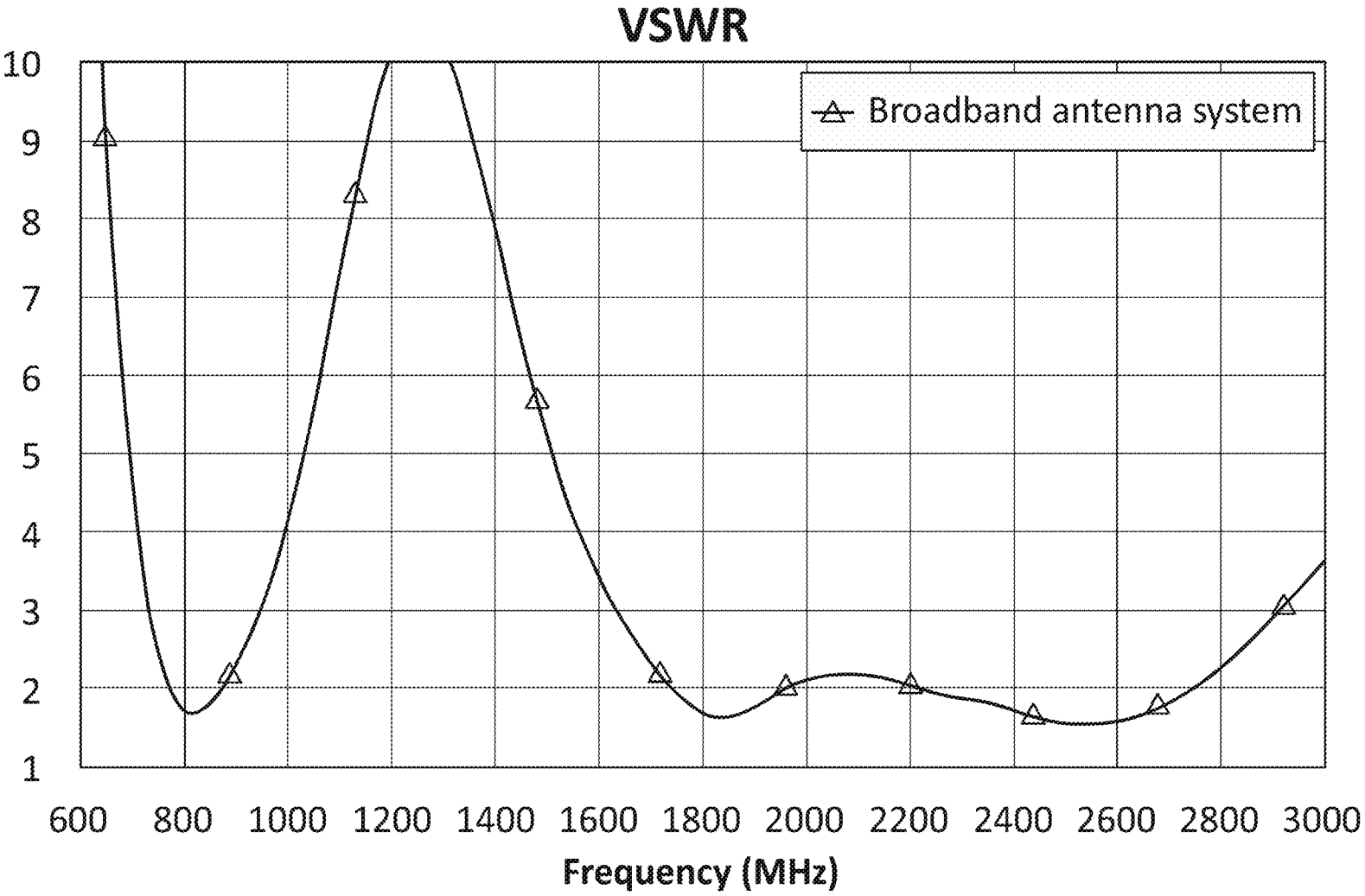
FIG. 7 shows a graphic of the Voltage Standing Wave Ratio (VSWR) of the main LTE antenna.
Figure 8:
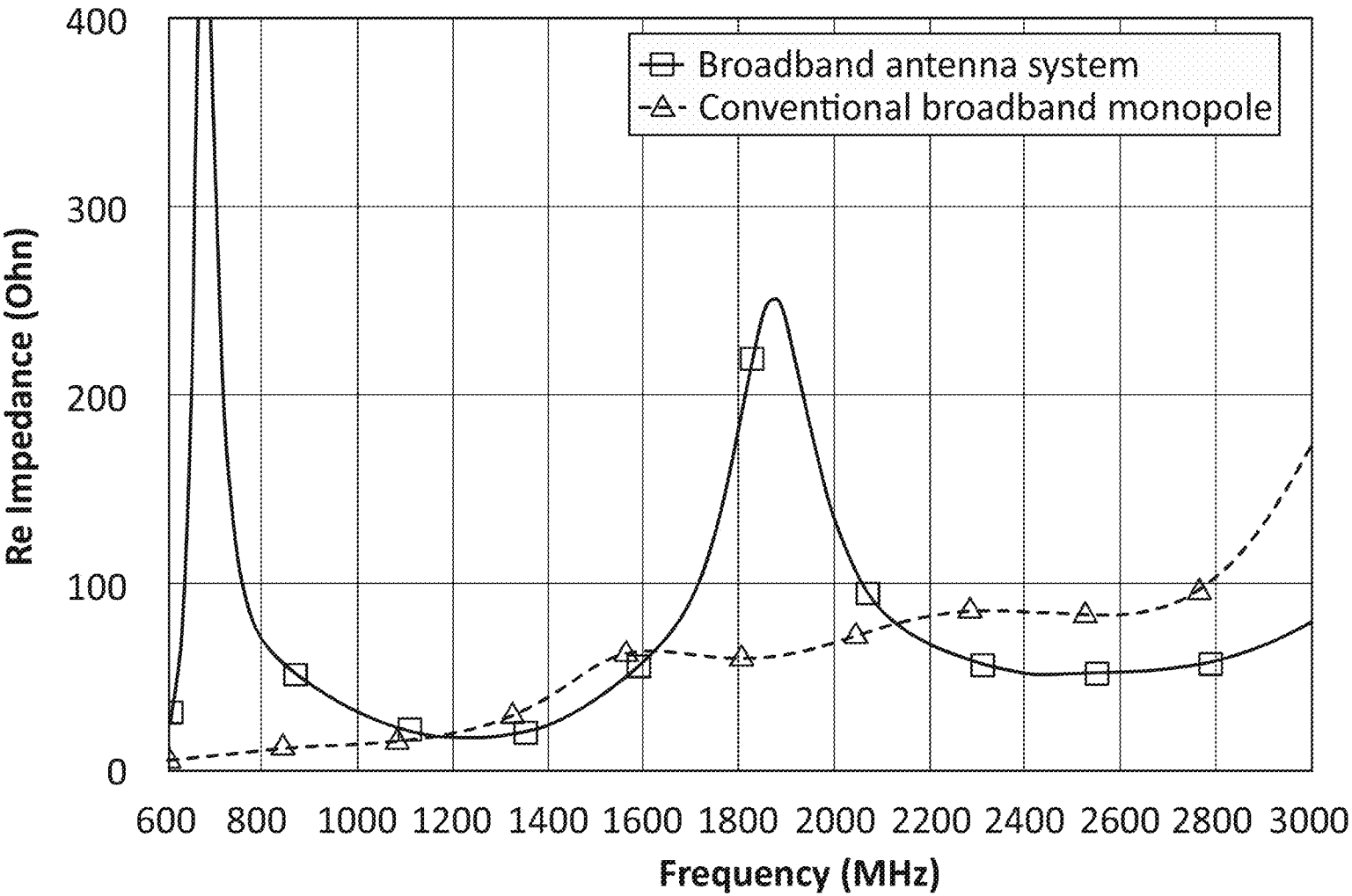
FIG. 8 shows a graphic of the real part of the impedance of a conventional broadband monopole, as shown in FIG. 1 (dashed line) vs the main LTE antenna (continuous line).
Figure 9:
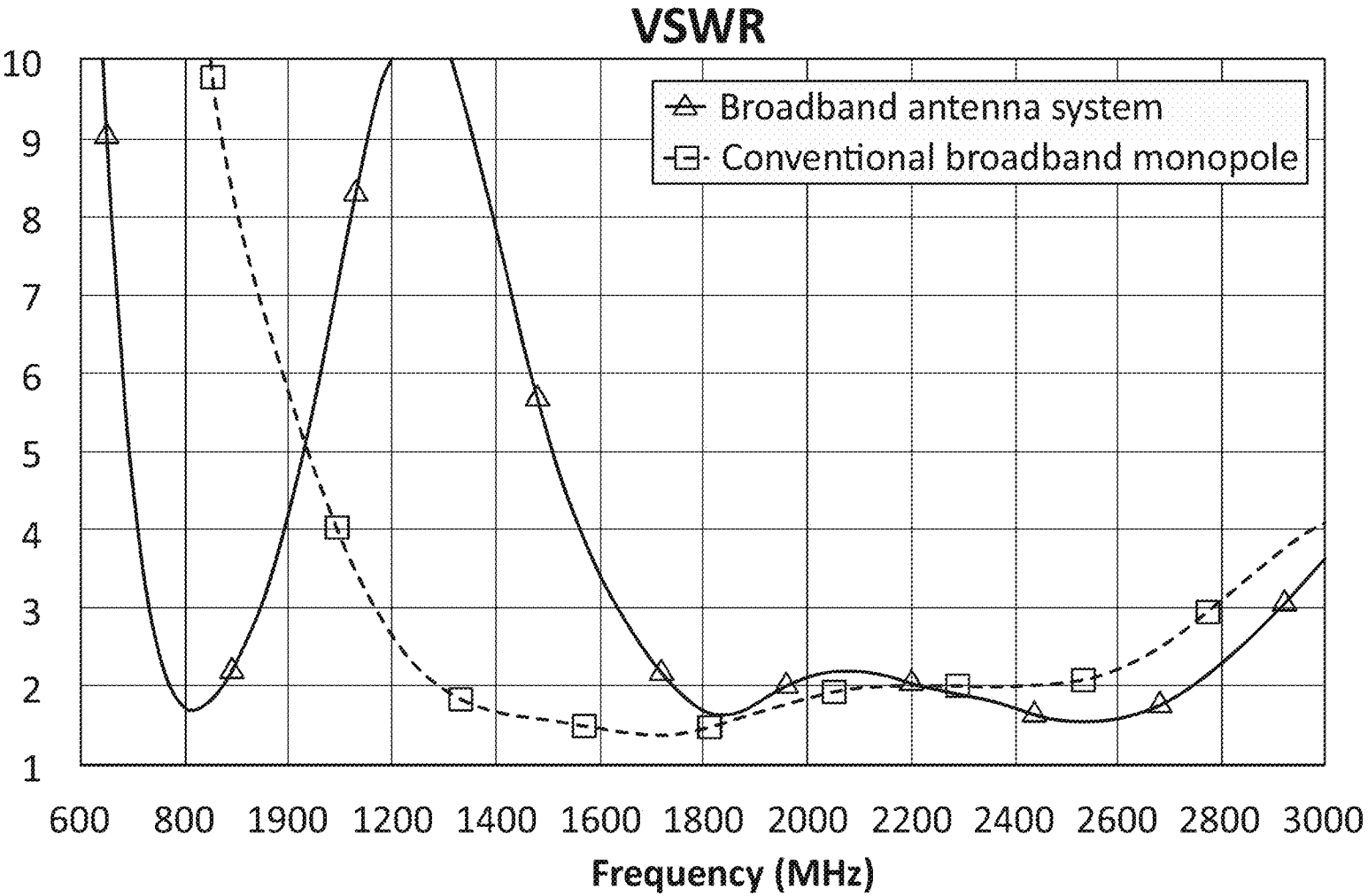
FIG. 9 shows a graphic of the VSWR of a conventional broadband monopole, as shown in FIG. 1 (dashed line) vs the main LTE antenna (continuous line).

FIGS. 7-9 respectively show graphics of the main LTE antenna 1 shown in FIG. 2 provided with a matching network.

FIG. 7 shows a graphic of the VSWR of the main LTE antenna 1 provided with a matching network. As shown, the VSWR<2.5 on the 95% of the bandwidth (700-960 MHz, 1600-2900 MHz) of the broadband LTE antenna system. The antenna offers good VSWR in the low frequency region and broadband behaviour in the high frequency region.

FIG. 8 shows the real part of the impedance of a conventional broadband λ/4 monopole in a dashed line, and the real part of the impedance of the main LTE antenna 1 of the disclosure in a continuous line. As shown, the value of the real part of the conventional monopole is lower than the desired 50 Ohm at the lower frequencies. The conductive element 5 of the main LTE antenna 1 helps to increase the real part of the impedance at the lower frequencies of LTE, thus, allowing the communication at these frequencies. Thus, the main LTE antenna 1 increases the antenna's impedance and generates a double frequency response.

FIG. 9 shows the VSWR measurement of a conventional broadband λ/4 monopole in a dashed line, and the VSWR measurement of the main LTE antenna 1 of the disclosure in a continuous line. As shown, the main LTE antenna 1 modifies the resonance frequency positions with respect to the conventional broadband monopole, getting an extended band of operation. The matching network allows reducing the absolute magnitude of the imaginary part of the impedance in order to achieve a good VSWR result.

Figure 10:
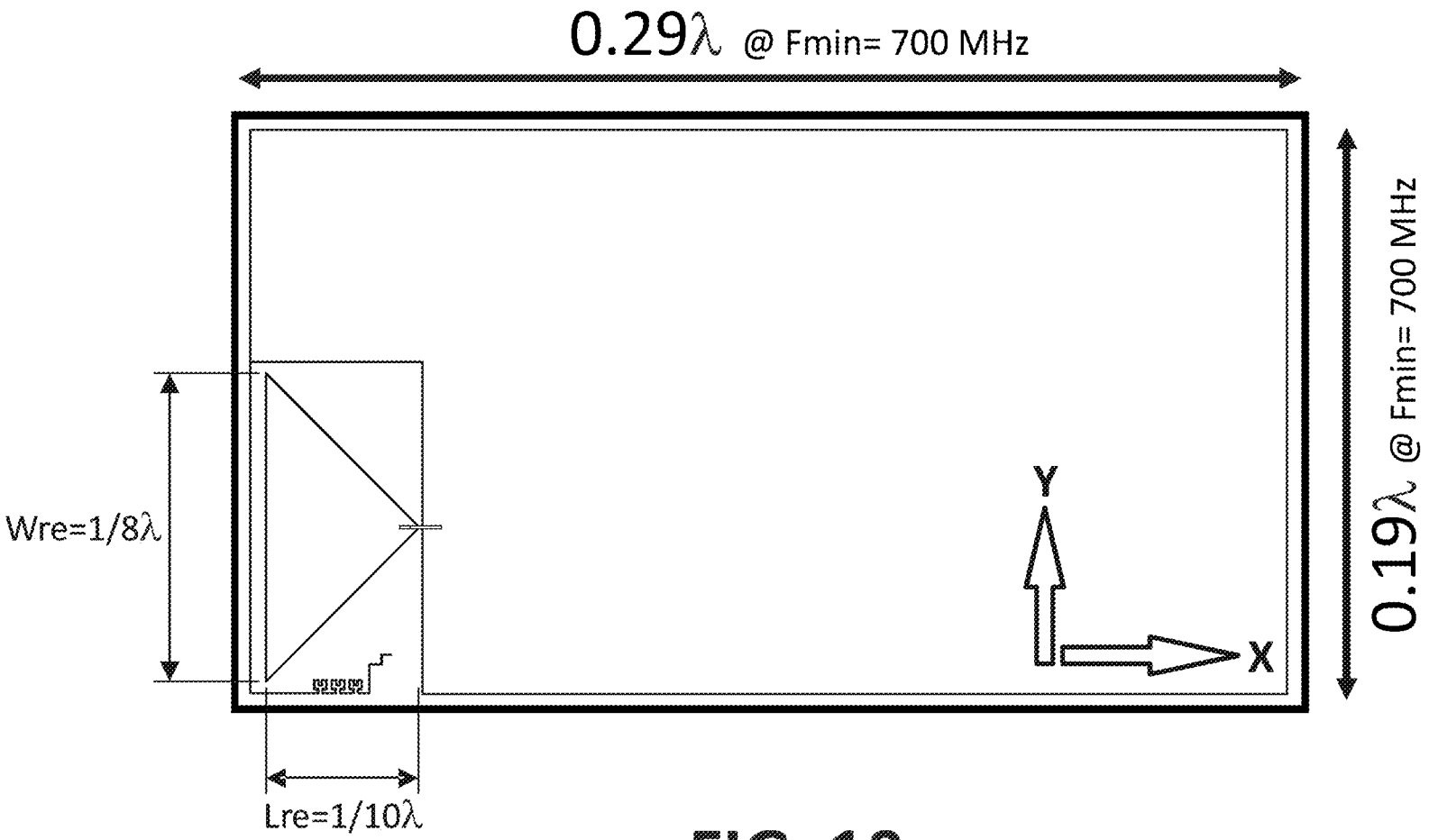
FIG. 10 shows a front view of the main LTE antenna wherein the preferred dimensions of the radiating element and the major and minor sides of the ground plane are indicated.

FIG. 10 shows a preferred design of a main LTE antenna 1. As indicated, the ground plane 2 is preferably shaped having minor sides 2*b* of 0.19λ, and major sides 2*a* of 0.29λ, being λ the lowest frequency of the LTE frequency band of operation of the main LTE antenna 1, i.e. 700 MHz.

Also, the radiating element 4 has a length (Lre) measured from the first side 7 to the first angle 6 greater than 1/10λ, and a width (Wre) measured as the length of the first side 7 of the radiating element 4 greater than 1/8λ, being λ the lowest frequency of the at least one LTE frequency band of operation of the main LTE antenna 1.

Figure 11:
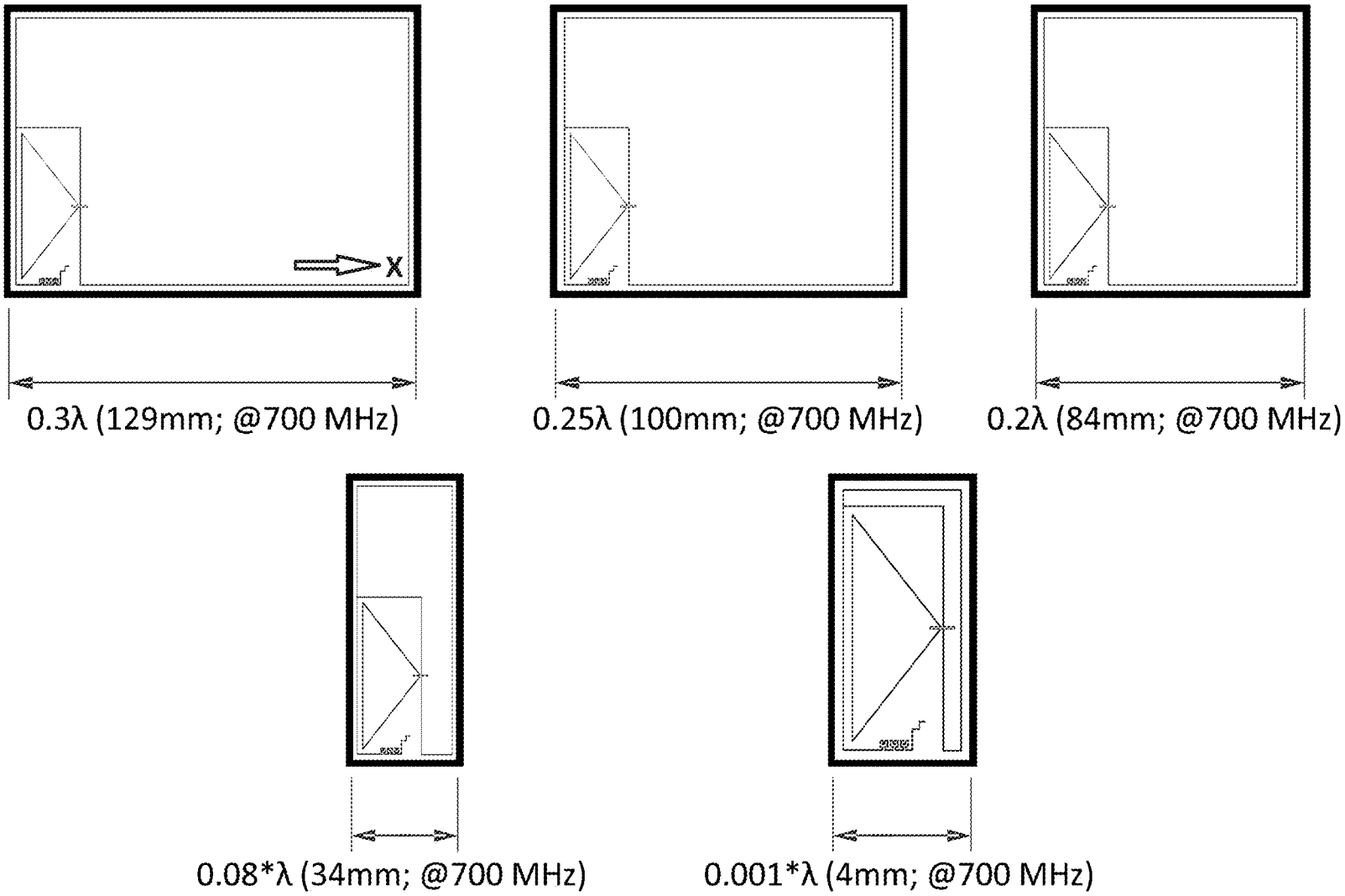
FIG. 11 shows several designs of the main LTE antenna of the disclosure, wherein the major dimension of the ground plane (X axis of FIG. 10) are progressively reduced starting from 0.3λ (129 mm at 700 MHz).

FIG. 11 shows several designs of the main LTE antenna 1 of FIG. 2, wherein the major sides 2*a* of the ground plane 2 (X axis of FIG. 10) are progressively reduced. The designs start having major sides 2*a* of 0.3λ (129 mm at 700 MHz), then major sides 2*a* are reduced to 0,λ (mm of reduction, i.e. having a length of 109 mm), to 0.2λ (45 mm of reduction, i.e. having a length of 84 mm), to 0.08λ (95 mm of reduction, i.e. having a length of 34 mm), and to 0.001λ (1 mm of reduction, i.e. having a length of 4 mm).

Figure 12:
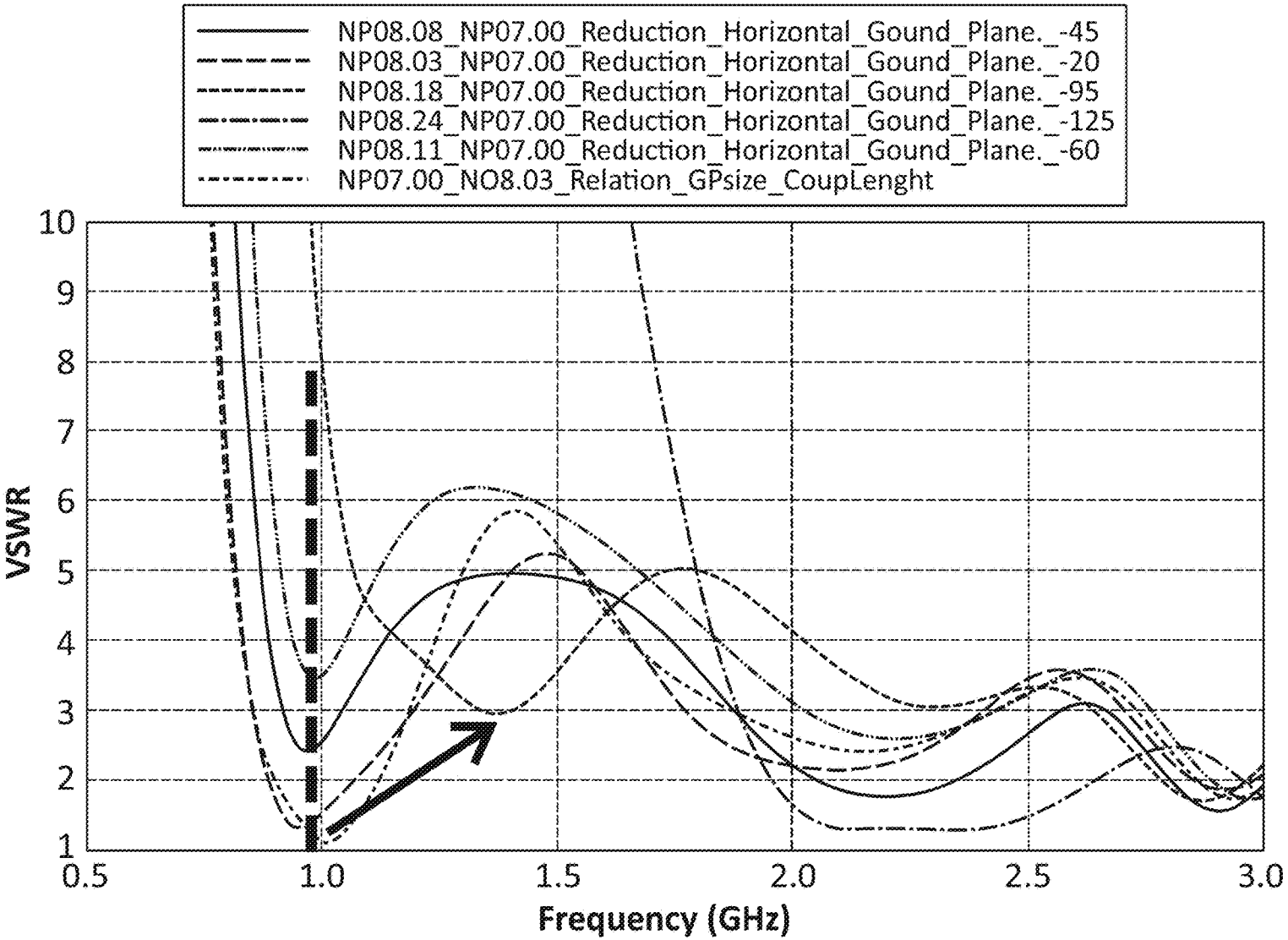
FIG. 12 shows a graphic of the VSWR's of the main LTE antenna of FIG. 11.

FIG. 12 shows the VSWR results of the different designs of ground planes of the main LTE antenna 1 shown in FIG. 11. As shown, when the ground plane is reduced greater than 60 mm, the VSWR of the main LTE antenna 1 goes outside specification at lower frequencies, and thus limiting the minimum size of the ground plane of the broadband LTE antenna system.

For that, the major sides 2*a* of the ground plane 2 have to be greater than 0.13λ, being λ the lowest frequency of operation of the broadband LTE antenna system, since, this way, at the lowest frequency band, i.e. 700 MHz (λ=4 mm), the major sides 2*a* of the ground plane 2 would be around 55 mm.

Figure 13:
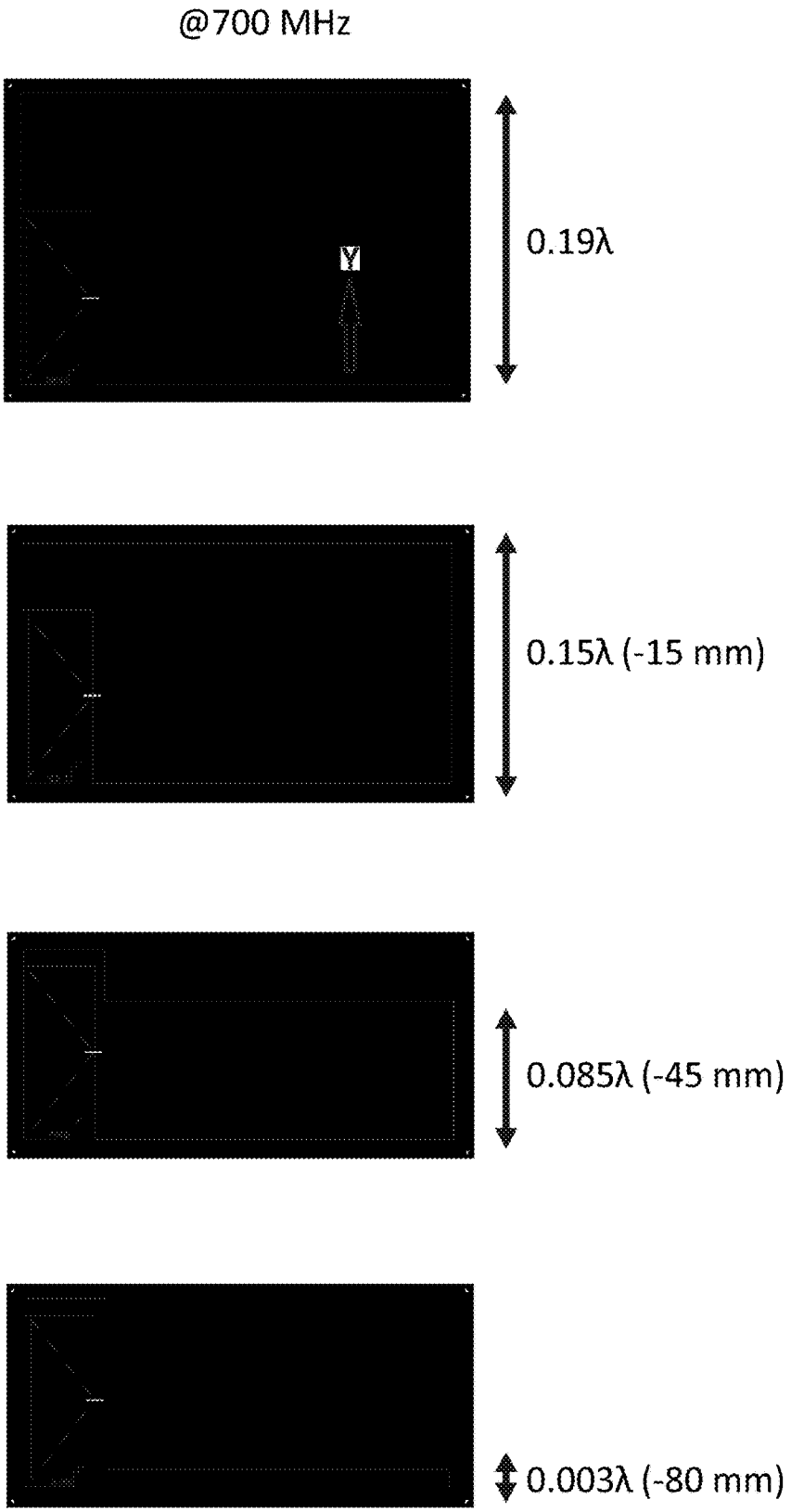
FIG. 13 shows several designs of the main LTE antenna of the disclosure, wherein the minor dimension of the ground plane (Y axis of FIG. 10) are progressively reduced starting from 0.3λ (129 mm at 700 MHz).

FIG. 13 shows several designs of the main LTE antenna 1 of FIG. 2, wherein the minor sides 2*b* of the ground plane 2 (Y axis of FIG. 10) are progressively reduced. The designs start having minor sides 2*b* of 0.19λ (81 mm at 700 MHz), then minor sides 2*b* are reduced to 0.15λ (15 mm of reduction, i.e. having a length of 66 mm), to 0.085λ (45 mm of reduction, i.e. having a length of 36 mm)), to 0.003λ (80 mm of reduction, i.e. having a length of 1 mm).

Figure 14:
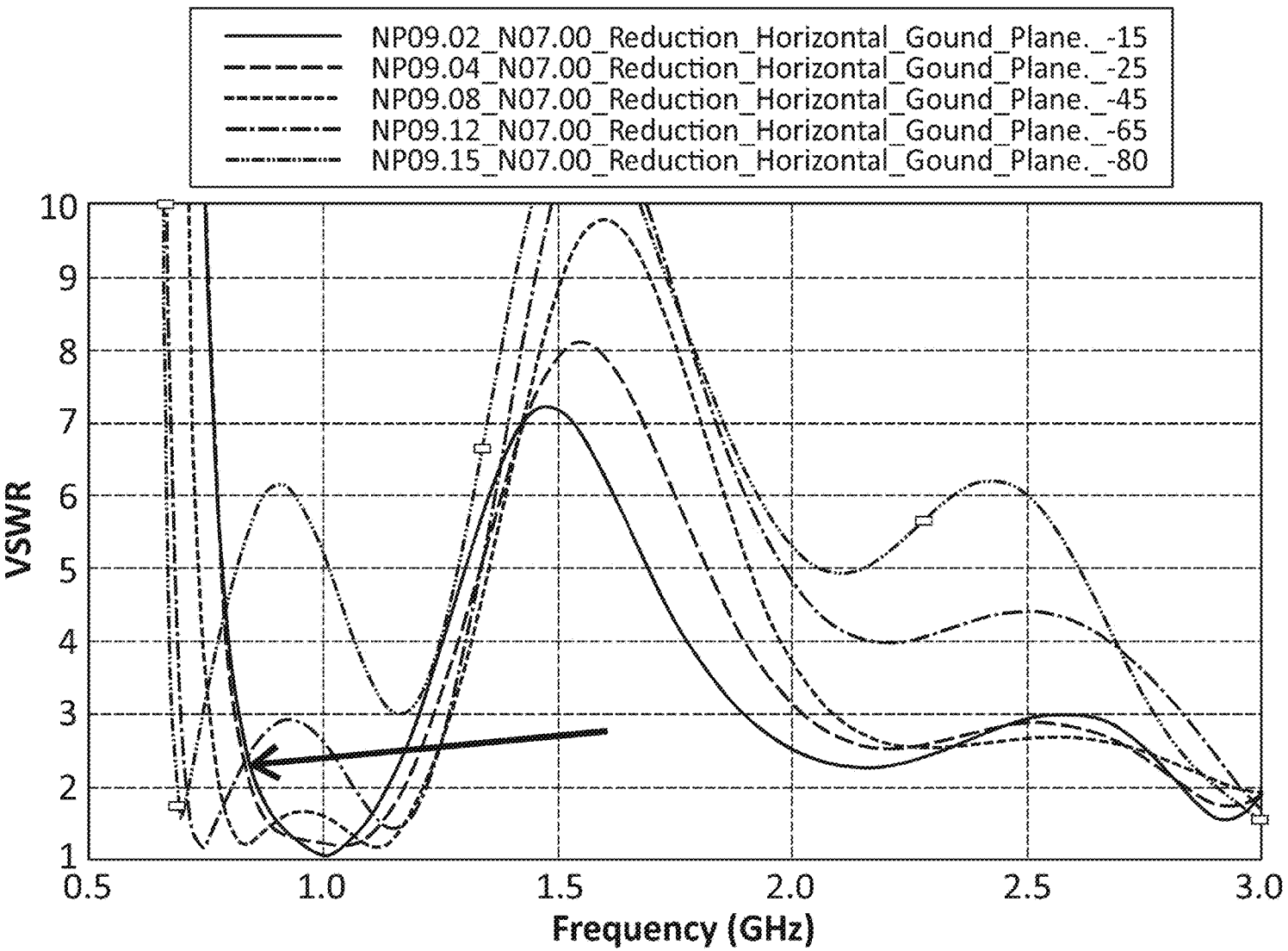
FIG. 14 shows a graphic of the VSWR's of the main LTE antenna of FIG. 13.

As shown in FIG. 14, the minor sides 2*b* configuration are no a limiting parameter, since the main LTE antenna 1 operates at all possible electric dimensions of minor sides 2*b*.

The radiating element 4 may have at least three angles and three sides, wherein a first side 7 is aligned with the minor side 2*b* of the ground plane 2, and a first angle 6 is the angle whose apex is the closest point of the radiating element 4 to the ground plane 2. In the figure, the first side 7 is the longer side of the radiating element 4, and the first angle 6 is lower than 156°.

Figure 15:
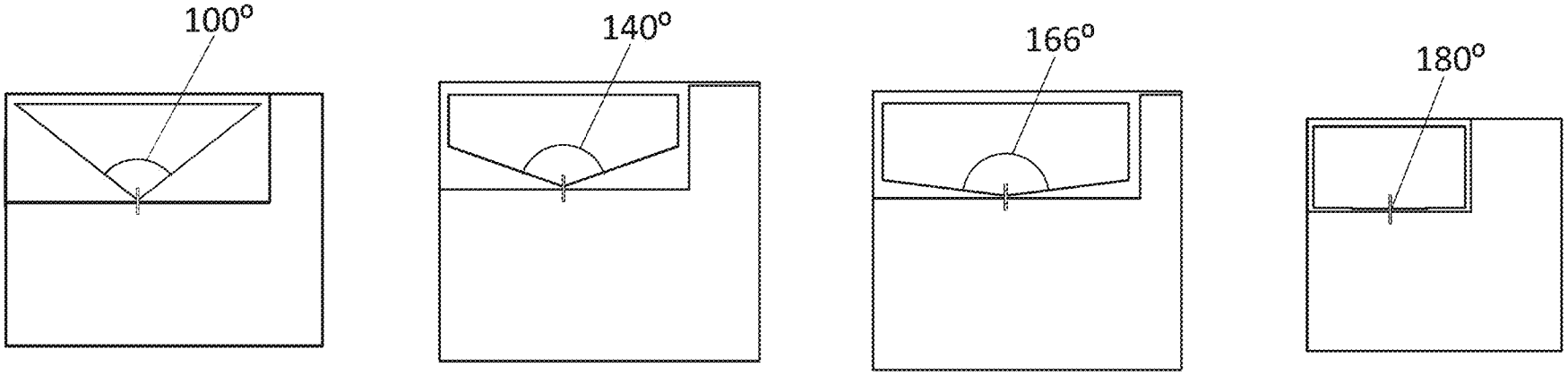
FIG. 15 shows several designs of the main LTE antenna of the disclosure, wherein the first angle of the radiating element is progressively increased starting from 100°.

FIG. 15 shows several designs of the main LTE antenna 1 of FIG. 2, wherein the first angle 6 of the radiating element is progressively increased. This first angle makes that currents flowing through each side of the radiating element are decoupled enough from the ground plane, achieving thus an optimum performance.

Figure 16:
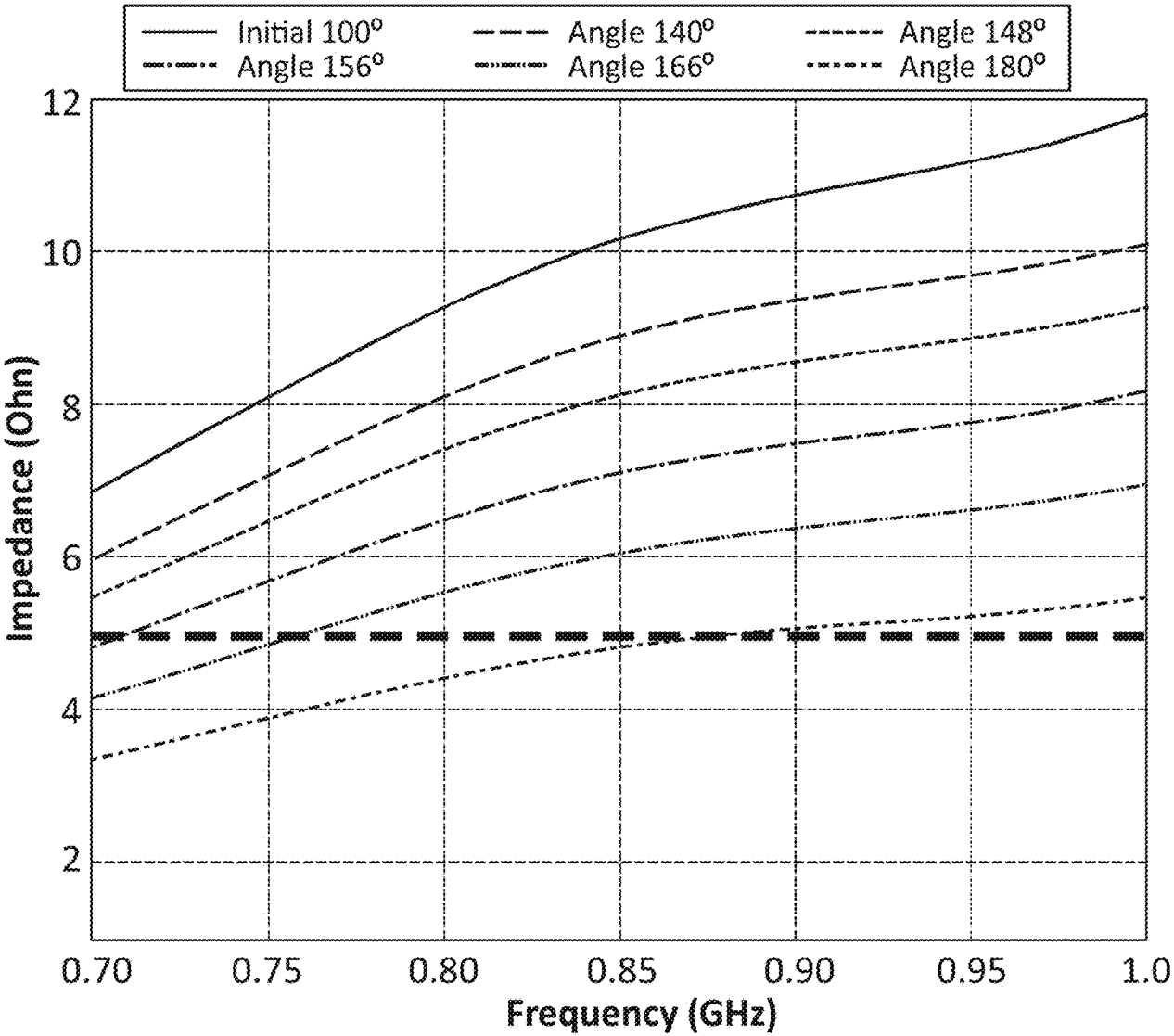
FIG. 16 shows a graphic of the impedance of the main LTE antenna of FIG. 15.

The first angle of the radiating element has a direct effect on the real part of the impedance of the main LTE antenna 1. For that, FIG. 16 shows a graphic of the impedance of the main LTE antenna 1 of FIG. 15. As known, the real part of the impedance of the antenna is directly related with the efficiency of the antenna. If the real part of the impedance is lower than 5Ω, the efficiency of the antenna will decrease extremely.

As shown, the first angle 6 has to be lower than 156° so as to the real part of the impedance of the main LTE antenna 1 is suitable for offering the mentioned antenna performance.

Figure 17A:
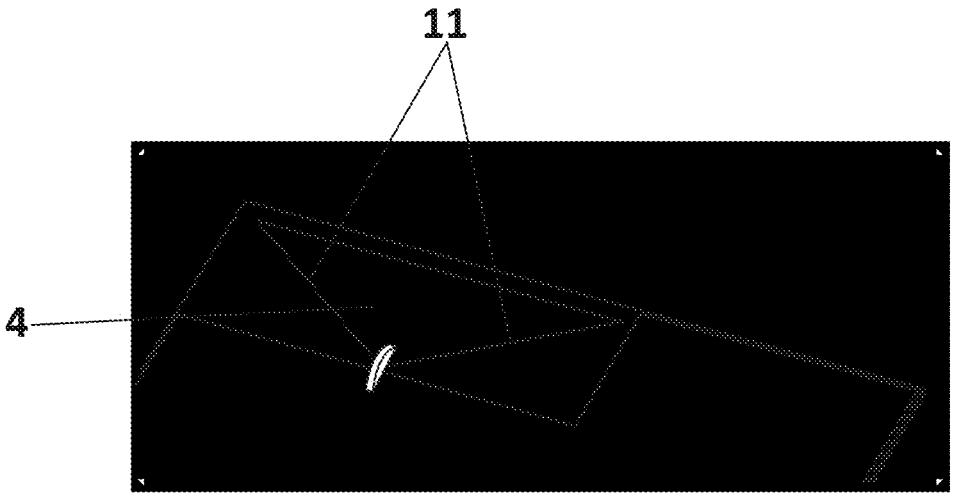
FIGS. 17*a* and 17*b* show front views of different main LTE antennas.
Figure 17B:
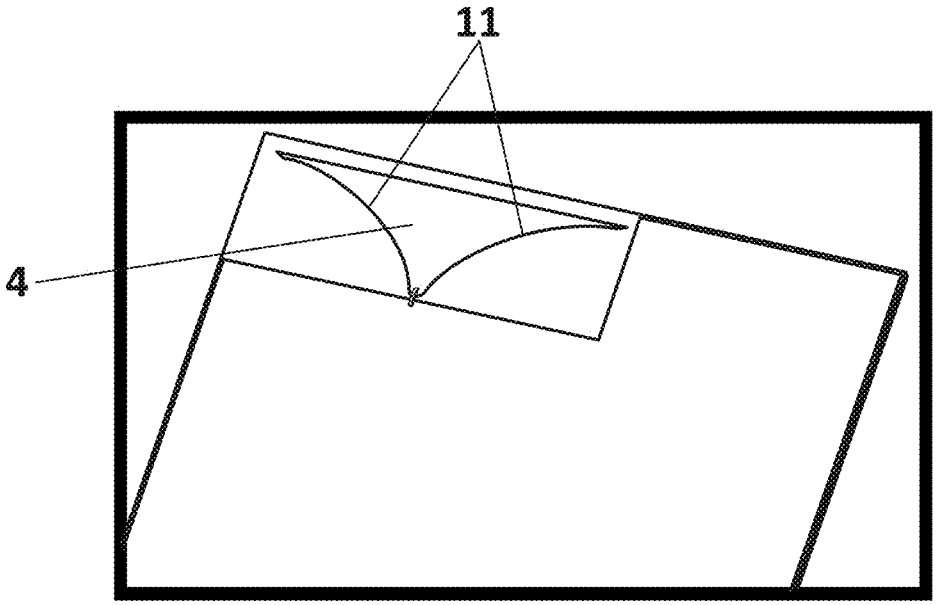

FIGS. 17*a* and 17*b* shows several designs in which the radiating element 4 has a substantially triangular configuration. In FIG. 17*a*, the radiating element 4 has straight sides 11. In FIG. 17*b*, the radiating element 4 has curved sides 11, in particular, concave-shaped sides.

Preferably, the sum of the electric length (Lgp) of a major side 2*a* of the ground plane 2 and the electric length (Lce) of the conductive element 5 ranges from 0.18λ to 0.22λ, being λ the lowest frequency of the at least one LTE frequency band of operation of the main LTE antenna 1.

Figure 18:
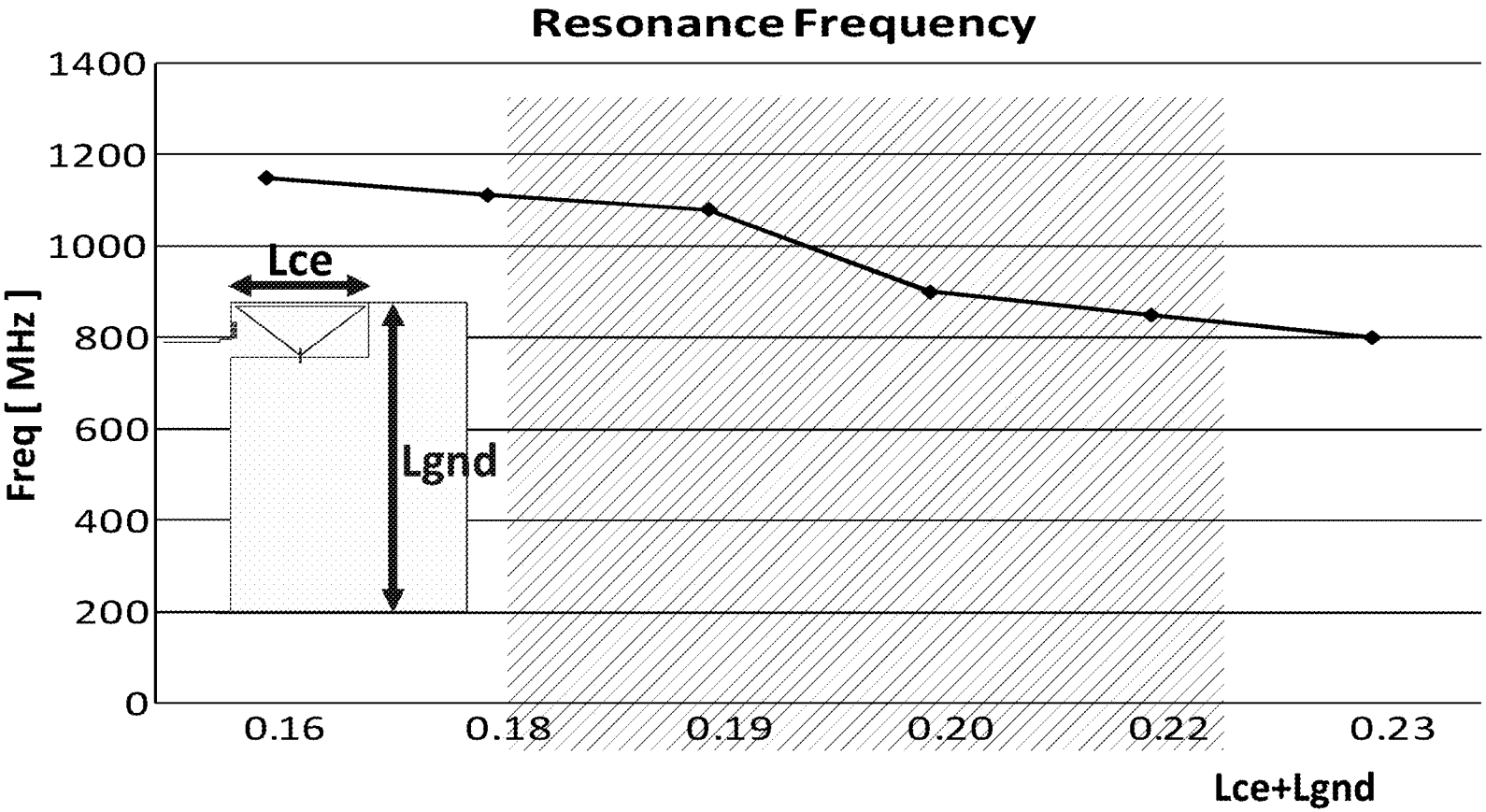
FIG. 18 shows a graphic of the resonant frequency of the main LTE antenna.
Figure 19:
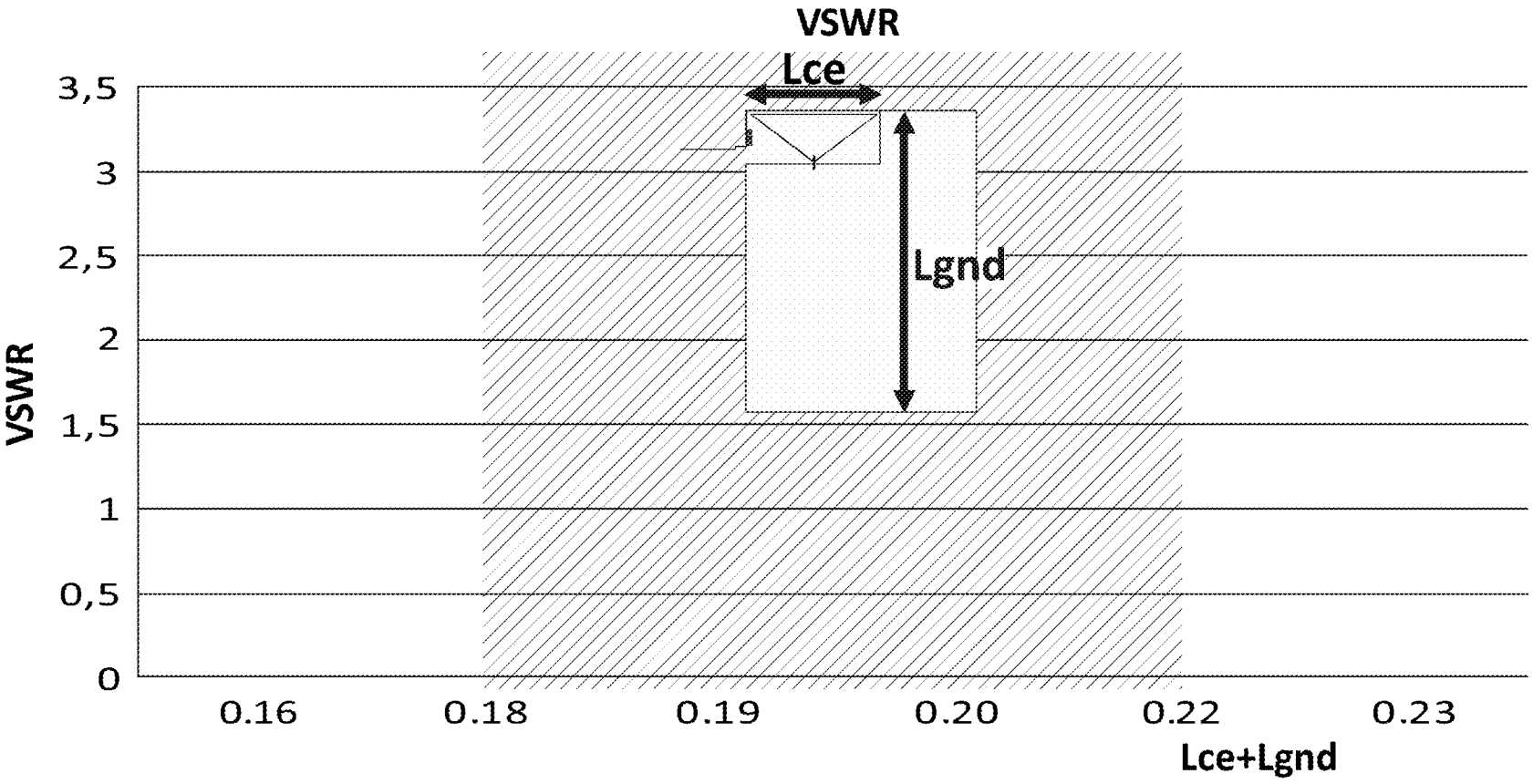
FIG. 19 shows a graphic of the VSWR of the main LTE antenna.

FIGS. 18 and 19 respectively show a graphic of the resonant frequency and the VSWR of the main LTE antenna 1 of FIG. 2. As shown, in the preferred range (0.18λ≤Lgp+Lce≤0.22λ), the main LTE antenna 1 achieves a VSWR greater than 1. and resonant frequencies ranging from 8 MHz to 1100 MHz at the lower frequencies of the LTE frequency band of operation.

Figure 20:
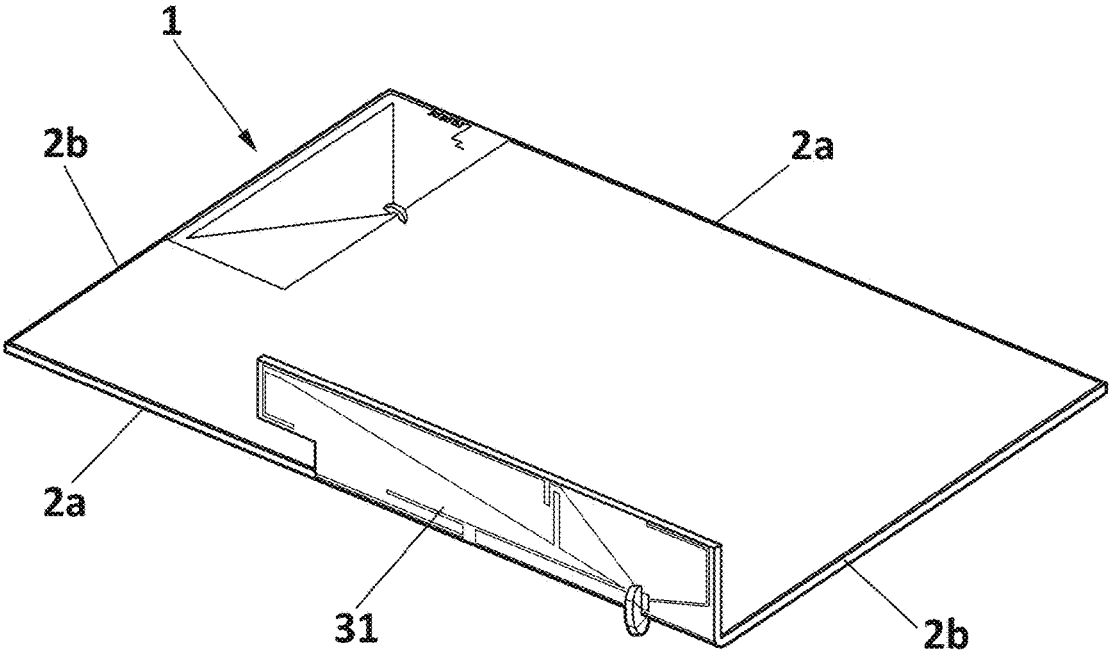
FIG. 20 shows a perspective view of a broadband LTE antenna system according with a preferred embodiment of the disclosure, including two LTE antennas (main and secondary) with decorrelated radiation patterns, and wherein both antennas are orthogonal to each other.

FIG. 20 show a preferred embodiment of the disclosure including the main LTE antenna (1) previously described, and a secondary LTE antenna (31), wherein the two LTE antennas are arranged relative to each other, such as their radiation patterns are perpendicular to each other, as a broadband LTE antenna system.

The main LTE antenna (1) is embodied as a printed antenna on a PCB for example of dimensions 126 mm×83 mm, small dimensions for LTE 700 MHz where the A=428 mm. The secondary LTE antenna (31) is also a printed antenna on a PCB for example of dimensions 80×15 mm, and it is arranged at one of the major sides (2*a*) of the ground plane (2), and it is orthogonally arranged with respect to the ground plane (2). Alternatively, in another embodiment shown on FIG. 23, the secondary LTE antenna 31) is coplanar with the ground plane (2).

Figure 21:
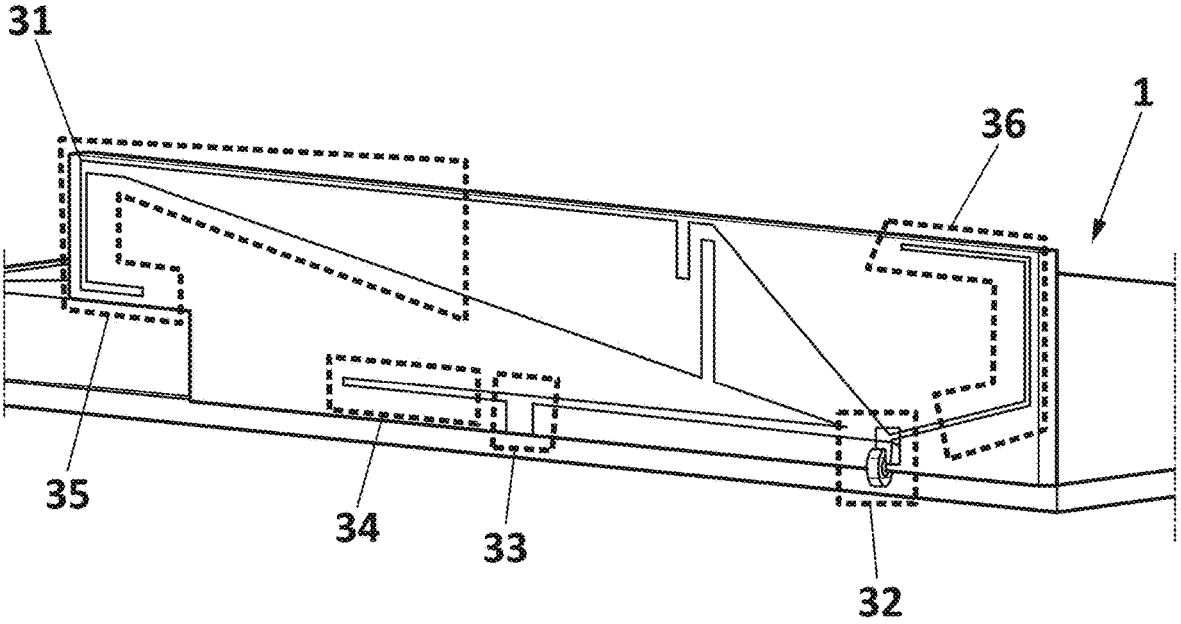
FIG. 21 shows an enlarged perspective view of the secondary LTE antenna of the embodiment of FIG. 21.
Figure 23:
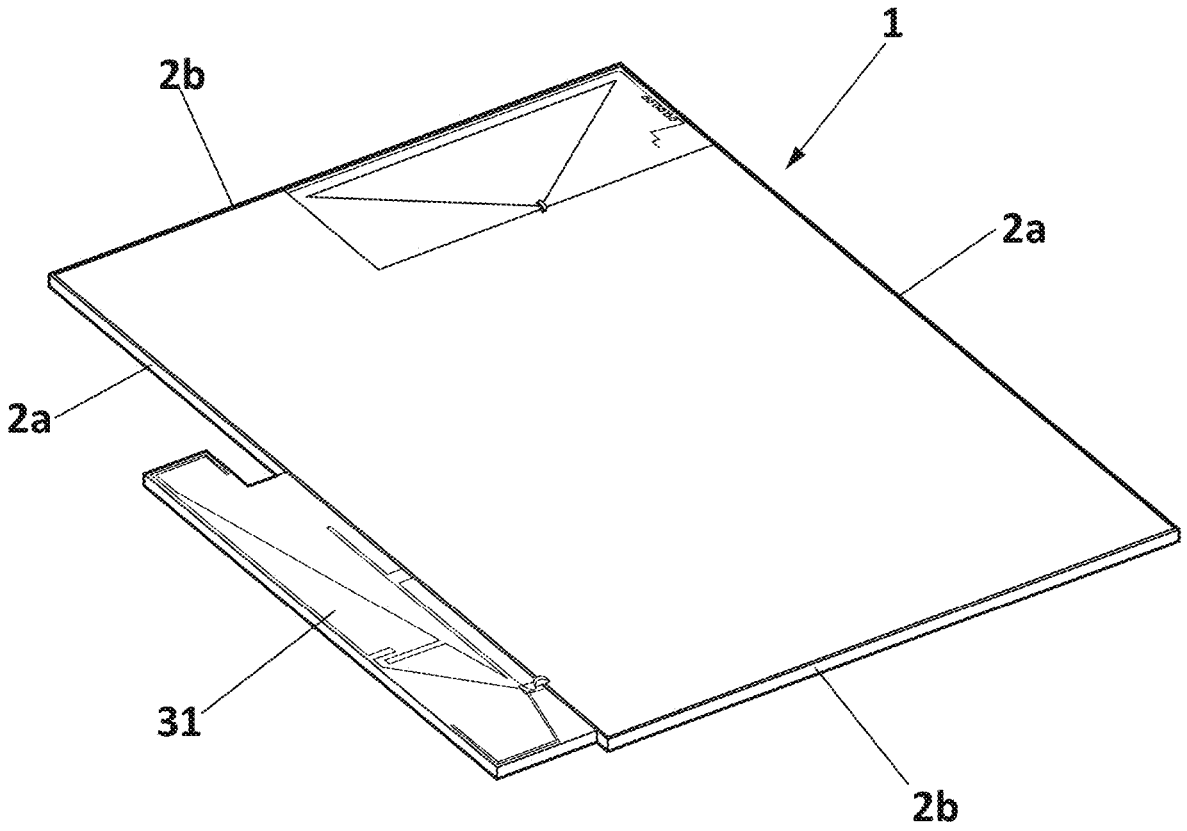
FIG. 23 shows a perspective view of another preferred embodiment of the disclosure including two LTE antennas (main and secondary) with decorrelated radiation patterns, wherein both antennas are coplanar.

It should be noted that in the embodiments of FIGS. 21 and 23, the radiating element (4) (one side thereof) and a secondary LTE antenna (31), are disposed at orthogonal sides of the ground plane (2) in order to achieve a perpendicular radiation patterns of the main LTE antenna (1) and secondary LTE antenna (31).

FIG. 21 shows that the secondary LTE antenna (31) has a connection point (32), a ground connection (33), and a first branch (34) for high band (00 Mhz-2700 Mhz) that extends from the ground connection (33) as a straight line. The secondary LTE antenna (31) also has a second branch ( ) for low band (700 Mhz-960 Mhz), and a third branch (36) for high band (1710 Mhz-2170 Mhz).

Figure 22:
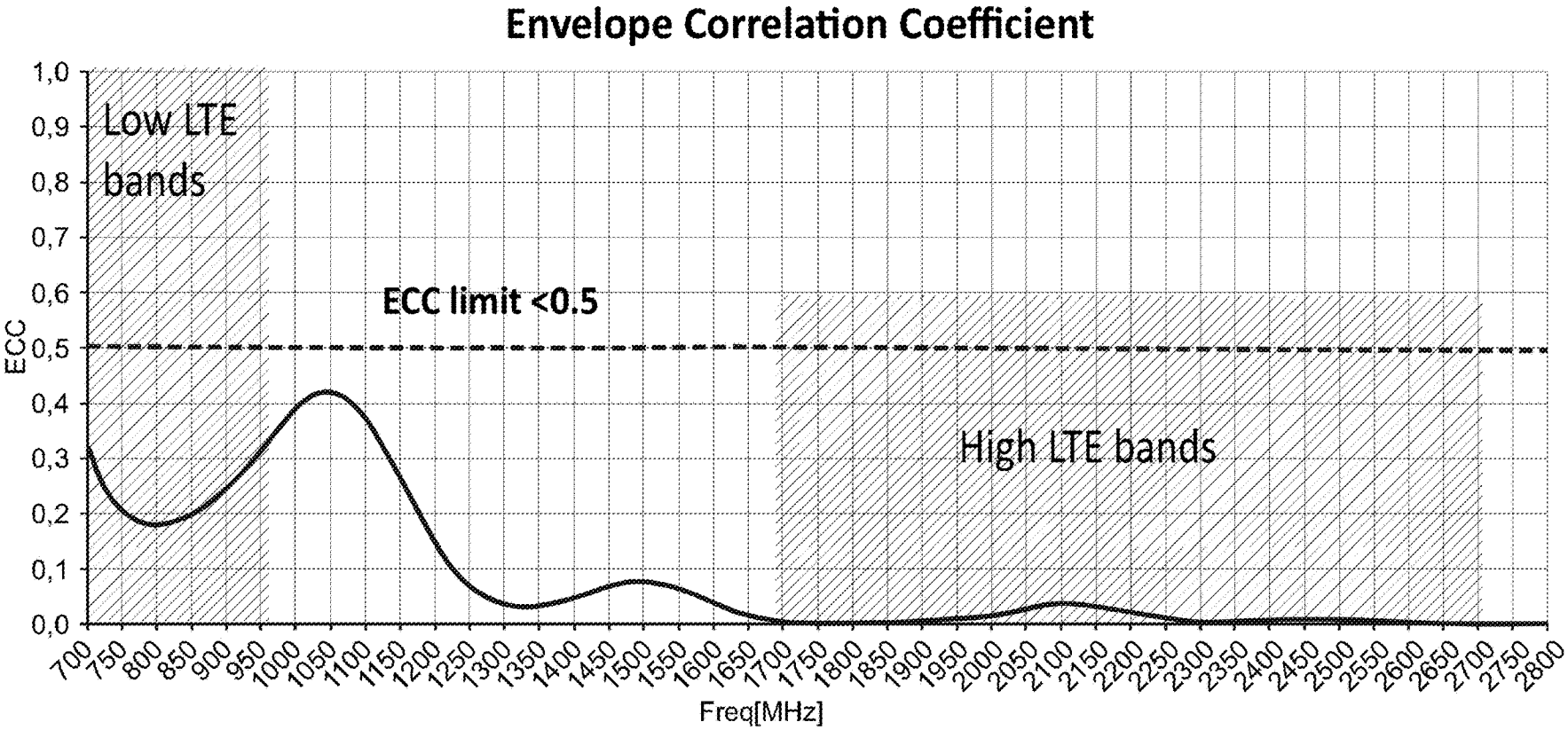
FIG. 22 shows a graphic of an ECC simulation of the embodiment of FIG. 21. The ECC limit specification is fixed at 0.5 as maximum due to mandatory American compliance normative.

FIG. 22 shows a graphic of an ECC simulation of the embodiment of FIGS. 20, 21, wherein it might be noted that optimization of the PCB antenna layout, achieves a very low ECC<0.3 at 700 MHz.

Due to the ECC at low LTE frequencies (700 MHz) was upper the limit (0.5), new LTE antennas layout was designed to improve the ECC at this band. The ECC improvement with the LTE antenna layout of the disclosure at 700 MHz is from 0.8 to 0.3.

What is claimed is:

1. A broadband LTE antenna system for a vehicle, comprising:

a main LTE antenna and a secondary LTE antenna, both antennas being arranged relative to each other, wherein radiation patterns of the antennas are perpendicular to each other, and wherein the main LTE antenna includes:

a ground plane having a first pair of opposing sides, and a second pair of opposing sides, wherein the ground plane is one of rectangular or quadrangular, a dielectric substrate including a first portion area, a radiating element for operating at least one frequency band of operation, the radiating element disposed on top of a first portion area of the substrate, and having at least three angles and three sides, a first side being substantially aligned with one side of the second pair of opposing sides, and a first angle having an apex, the apex being the closest point of the radiating element to the ground plane, a grounding point disposed at one extreme of the first portion area of the substrate and coupled to the ground plane, a feeding element electromagnetically coupled with the radiating element through the apex of the first angle, and a conductive element, electrically isolated from the radiating element, disposed on the first portion area of the substrate and coupled to the grounding point, the conductive element having at least a first portion extending between the radiating element and one of the sides of the first portion area of the substrate, wherein each side of the ground plane has an electric length (Lgp) of at least 0.13λ, λ being the lowest frequency of the antenna system, and wherein the first angle of the radiating element has an aperture lower than 156°, and wherein the secondary LTE antenna is a printed antenna on a PCB, and it is arranged at one side of the first pair of opposing sides of the ground plane.

2. The broadband LTE antenna system for a vehicle, according to claim 1, wherein the secondary LTE antenna is one of coplanar or orthogonally arranged with respect to the ground plane.

3. The broadband LTE antenna system for a vehicle, according to claim 1, wherein the conductive element has an electric length (Lce), and wherein the sum of the electric length of the major side of the circumscribed rectangle of the ground plane and the electric length of the conductive element ranges from 0.18λ to 0.22λ, λ being the lowest frequency of the broadband LTE antenna system.

4. The broadband LTE antenna system for a vehicle, according to claim 1, wherein the radiating element has a length measured from the first side to the first angle lower than 1/10λ, and a width (Wre) measured as the length of the first side of the radiating element lower than 1/8λ, λ being the lowest frequency of the broadband LTE antenna system.

5. The broadband LTE antenna system for a vehicle, according to claim 1, wherein the conductive element is spaced from the radiating element by at least 50 μm.

6. The broadband LTE antenna system for a vehicle, according to claim 1, wherein the first portion of the conductive element is bigger than 1/8λ, λ being the lowest frequency of the broadband LTE antenna system.

7. The broadband LTE antenna system for a vehicle, according to claim 1, wherein the substrate comprises a second portion area, and wherein the ground plane is disposed on said second portion area.

8. The broadband LTE antenna system for a vehicle, according to claim 1, wherein the radiating element has a substantially triangular configuration.

9. The broadband LTE antenna system for a vehicle, according to claim 1, wherein the radiating element has curved sides.

10. The broadband LTE antenna system for a vehicle, according to claim 1, further comprising a matching network coupling the radiating element with the feeding element.

11. The broadband LTE antenna system for a vehicle, according to claim 1, wherein the conductive element defines an open extreme shaped as a space-filling curve.

12. The broadband LTE antenna system for a vehicle, according to claim 1, further comprising at least one additional antenna selected from the group of: a satellite digital audio radio services (SDARS) antenna, a global navigation satellite system (GNSS) antenna, a digital audio broadcasting (DAB) antenna, and an AM/FM antenna.

13. The broadband LTE antenna system for a vehicle, according to claim 1, wherein the frequency band of operation is the LTE frequency band of operation, and λ corresponds to the lowest frequency of the LTE band, which is 700 MHz.

14. The broadband LTE antenna system for a vehicle, according to claim 13, wherein the LTE frequency band of operation includes a first band ranging from 700 MHz to 960 MHz, a second band ranging from 1400 MHz to 1500 MHz, a third band ranging from 1700 MHz to 20 MHz, and a fourth band ranging from 00 MHz to 2700 MHz.

15. A main LTE antenna, comprising:

a ground plane having a first pair of opposing sides, and a second pair of opposing sides, wherein the ground plane is one of rectangular or quadrangular, a dielectric substrate including a first portion area, a radiating element for operating at least one frequency band of operation, the radiating element disposed on top of a first portion area of the substrate, and having at least three angles and three sides, a first side being substantially aligned with one side of the second pair of opposing sides, and a first angle having an apex, the apex being the closest point of the radiating element to the ground plane, a grounding point disposed at one extreme of the first portion area of the substrate and coupled to the ground plane, a feeding element electromagnetically coupled with the radiating element through the apex of the first angle, and a conductive element, electrically isolated from the radiating element, disposed on the first portion area of the substrate and coupled to the grounding point, the conductive element having at least a first portion extending between the radiating element and one of the sides of the first portion area of the substrate, wherein each side of the ground plane has an electric length (Lgp) of at least 0.13λ, λ being the lowest frequency of the antenna system, and wherein the first angle of the radiating element has an aperture lower than 156°, and wherein the secondary LTE antenna is a printed antenna on a PCB, and it is arranged at one side of the first pair of opposing sides of the ground plane.

16. The antenna according to claim 15, wherein the secondary LTE antenna is one of coplanar or orthogonally arranged with respect to the ground plane.

17. The antenna according to claim 15, wherein the conductive element has an electric length (Lce), and wherein the sum of the electric length of the major side of the circumscribed rectangle of the ground plane and the electric length of the conductive element ranges from 0.18λ to 0.22λ, λ being the lowest frequency of the broadband LTE antenna system.

18. The antenna according to claim 15, wherein the radiating element has a length measured from the first side to the first angle lower than 1/10λ, and a width (Wre) measured as the length of the first side of the radiating element lower than 1/8λ, λ being the lowest frequency of the broadband LTE antenna system.

19. The antenna according to claim 15, wherein the conductive element is spaced from the radiating element by at least 50 μm.

20. The antenna according to claim 15, wherein the first portion of the conductive element is bigger than 1/8λ, λ being the lowest frequency of the broadband LTE antenna system.

* * * * *